US005295384A

United States Patent [19]

Schubert

[11] Patent Number: 5,295,384

[45] Date of Patent: Mar. 22, 1994

[54] SHEET-METAL BENDING DEVICE

[75] Inventor: Otto Schubert, Vienna, Austria

[73] Assignee: Lift Verkaufsgerate Gesellschaft M.b.H., Austria

[21] Appl. No.: 847,749

[22] Filed: Mar. 5, 1992

Related U.S. Application Data

[63] Continuation-in-part of Ser. No. 772,376, Nov. 12, 1991.

[30] Foreign Application Priority Data

Sep. 18, 1991 [AU] Australia ..... 1878/91

[51] Int. Cl.[5] ..... B21D 5/02

[52] U.S. Cl. ..... 72/389; 72/383; 72/413

[58] Field of Search ..... 72/381, 383, 389, 413, 72/499, 481

[56] References Cited

U.S. PATENT DOCUMENTS

| | | | |
|---|---|---|---|
| 1,045,089 | 11/1912 | Belding et al. . | |
| 1,258,892 | 3/1918 | Grifein . | |
| 1,633,744 | 6/1927 | Hughes . | |
| 2,433,841 | 1/1948 | Glud | 152/33 |
| 2,649,128 | 8/1953 | Schuellerman | 153/48 |
| 3,044,526 | 7/1962 | Cady | 153/16 |
| 3,282,076 | 11/1966 | Cady, Jr. | 72/35 |
| 3,845,655 | 11/1974 | Krieg | 72/389 |
| 3,877,279 | 4/1975 | Van Cleave | 72/319 |
| 4,282,735 | 8/1981 | Break | 73/319 |
| 4,328,695 | 5/1982 | Beaumont | 72/389 |
| 4,640,113 | 2/1987 | Dieperink et al. | 72/21 |

FOREIGN PATENT DOCUMENTS

| | | | |
|---|---|---|---|
| 0155228 | 3/1984 | European Pat. Off. . | |
| 0379886 | 8/1990 | European Pat. Off. . | |
| 0115961 | 6/1899 | Fed. Rep. of Germany . | |
| 1237408 | 3/1967 | Fed. Rep. of Germany | 72/389 |
| 1402118 | 1/1969 | Fed. Rep. of Germany . | |
| 2418668 | 10/1975 | Fed. Rep. of Germany . | |
| 2741001 | 3/1978 | Fed. Rep. of Germany . | |
| 0243222 | 2/1987 | Fed. Rep. of Germany . | |
| 1221933 | 6/1960 | France . | |
| 1396575 | 2/1965 | France | 72/389 |
| 2201973 | 5/1974 | France . | |
| 1215 | 1/1966 | Japan | 72/389 |
| 62-217125 | 6/1987 | Japan . | |
| 63-36923 | 2/1988 | Japan . | |
| 63-199028 | 8/1988 | Japan . | |
| 812535 | 9/1981 | PCT Int'l Appl. . | |
| 0388886 | 3/1965 | Switzerland . | |
| 0430919 | 6/1974 | U.S.S.R. | 72/389 |
| 1059892 | 2/1967 | United Kingdom | 72/389 |
| 1119811 | 7/1968 | United Kingdom . | |
| 2050887 | 1/1981 | United Kingdom . | |

*Primary Examiner*—David Jones
*Attorney, Agent, or Firm*—Ladas & Parry

[57] ABSTRACT

A sheet bending device (1) is described, comprising two bending punches (19, 20), pivotally connected together, which are disposed alongside each other in a frame (2), and of which at least one is pivotally mounted and is coupled to a pivoting drive (24), and comprising a counter-punch (10), situated opposite the bending punches (19, 20) and arranged to be linearly movable between a working position on the sheet (18) and a retracted position, about which counter-punch the sheet (18) is bent in the working position, wherein the two bending punches (19, 20) are articulated to each other or pivotally supported in the frame (2) in the working region itself.

16 Claims, 27 Drawing Sheets

FIG. 19
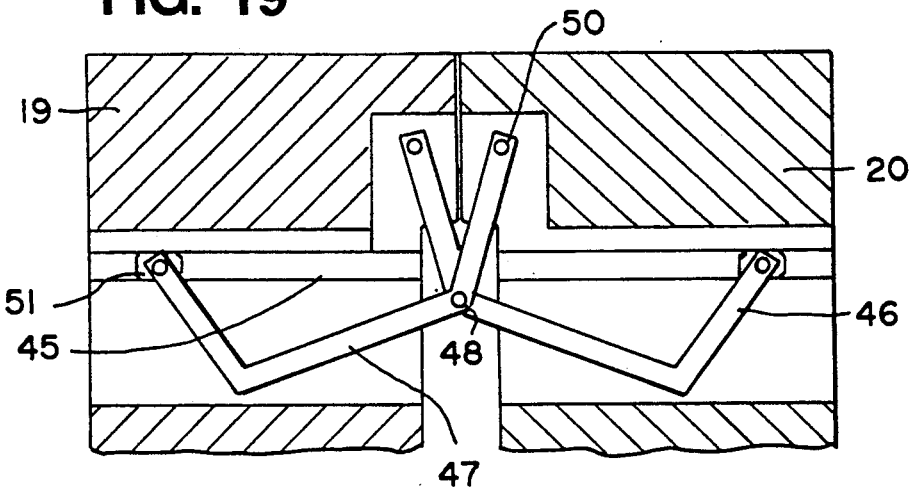
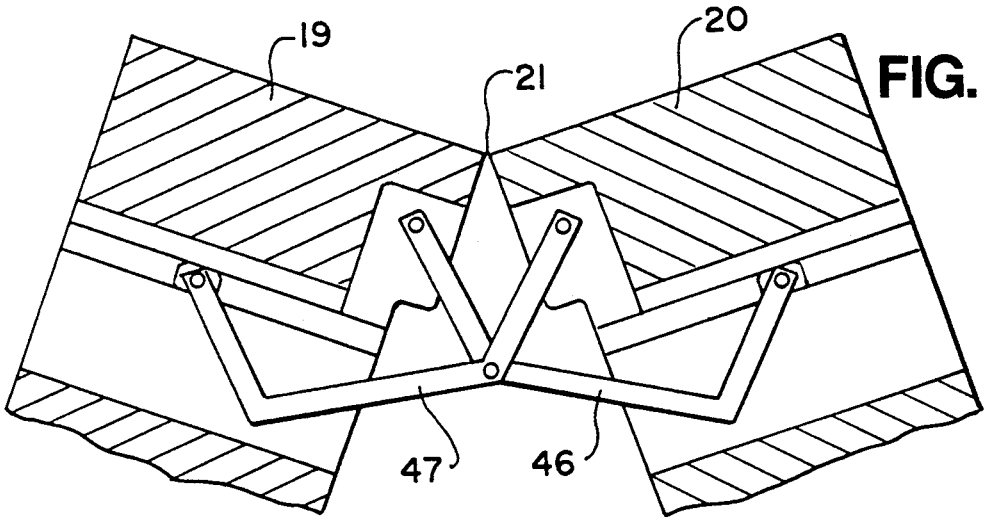
FIG. 20
FIG. 21
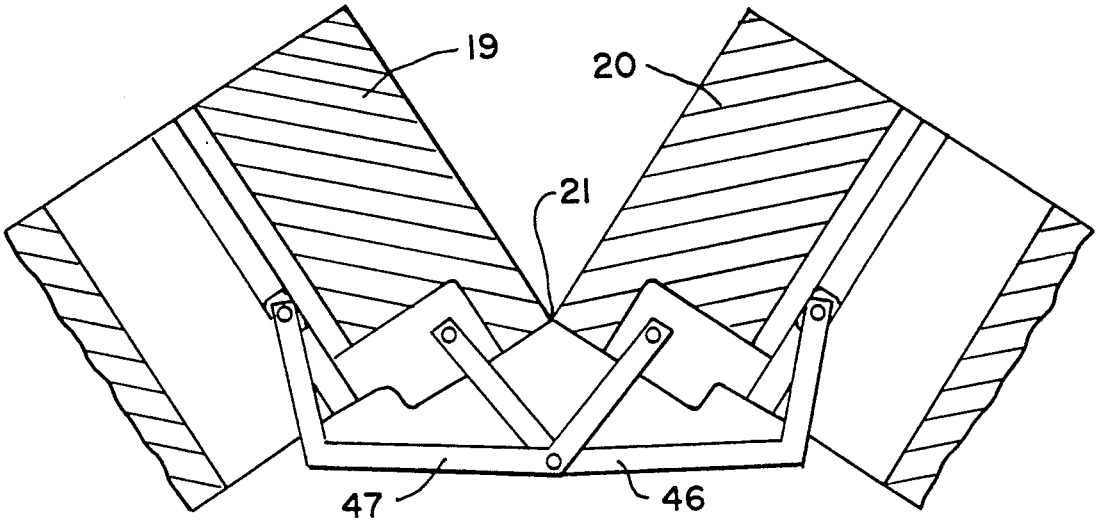

SHEET-METAL BENDING DEVICE

This application is a continuation-in-part of U.S. application Ser. No. 07/772,376, filed Nov. 12, 1991.

This invention relates to a sheet bending device comprising two bending punches, pivotally connected together, which are disposed alongside each other in a frame and which define, in a working region having sheet contact zones, a sheet bearing plane in the at-rest position, of which at least one is pivotally mounted and is coupled to a pivoting drive, and comprising a counter-punch situated opposite the bending punches and disposed linearly movable between a working position against the metal sheet and a retracted position, the sheet being bent about this counter-punch in the working position.

The best known and most widely adopted technique for bending metal sheets or sheet edges consists in moving an upper bending punch against the sheet resting on a lower die, the bending punch pressing the sheet into the die at the region where the bent edge is to be formed (see, for example, FR-A-2 201 973 and also U.S. Pat. No. 2,649,128), thus causing the sheet to be bent. It is disadvantageous that as a rule a precisely defined or sharp bent edge cannot be obtained, that for each die only a quite specific bend, that is a quite specific angle of bend, can be produced and that, furthermore, a considerable part of the energy applied is lost due to friction on the die. These disadvantages also apply basically to those die devices in which the die is subdivided into two die components, movably mounted in a holder and especially pivotally connected to each other, see in this connection, for example, DE-C-115 961 or EP-A-379 886, FR-A-1 221 933 or DE-A-1 402 118, DE-A-2 418 668, U.S. Pat. No. 1,045,089, U.S. Pat. No. 1,258,892, U.S. Pat. No. 1,633,744, U.S. Pat. No. 2,433,841, JP-A-62-127125, JP-A-63-36923 and also JP-A-63-199028. In all these forms of construction the actual bending work is applied by the upper bending punch, which must be correspondingly robust in construction and be equipped with a suitably heavily dimensioned actuating drive.

A bending device is also known for already profiled sheets (WO 81/02535), for providing these sheets with a corrugation, wherein an upper punch, movable up and down, cooperates with a stationary, lower punch and with inclined auxiliary punches disposed either side thereof and movable obliquely up and down in the direction of their principal plane. While the upper punch, together with the stationary lower punch opposite it, forms the corrugation in the sheet, the two lateral, inclined punches prepare the next corrugation. This known bending machine is not designed and also is not suitable for a simple bending of a sheet to the sharpest possible bent edge.

Starting from pivotal bending machines, in which the metal sheet to be bent is clamped between a stationary lower cheek and an upper cheek which can be clamped against this, and a lower, pivoting bending cheek performs the bending operation, sheet bending devices have then been proposed in U.S. Pat. No. 3,044,526 and DE-A-1 402 838 respectively, in U.S. Pat. No. 3,282,076, in GB-A-1 119 811 and in GB-A-2 050 887, in which two lower bending punches can be pivoted about horizontal axes in opposite directions in order to bend the sheet about an upper counter-punch situated opposite them. In this arrangement, the pivot bearings for the two lower bending punches are mounted externally on the two end faces of the bending device, the pivoting drives in the form of power cylinders being also provided at these end faces. A disadvantage here is, particularly, that the bending punches must be of extraordinarily heavy construction, especially where large widths of machine (e.g. 2 m or 3 m) are desired, while nevertheless a sharp, precise bend in the sheet cannot be achieved in the region of the machine centre, but indeed the bent sheet in this central region as a rule is still "more open" than in the region of the ends, that is to say the bent sheet has a curved, convex shaped as viewed along the length of the bend. In conjunction with the necessary massive construction of the bending punches, the machine width as a rule is limited on account of the necessary masses, that is to say machine widths exceeding 3 m can scarcely be achieved because the total mass of the device would be excessively increased. The result of this would be bending machines having a mass of 15 to 20 tonnes and more.

It is now the objective of this invention to provide a sheet bending device of the initially stated type, which shall make possible bending of sheets while achieving sharp bent edges with relatively low energy consumption, wherein in particular a wide variety of profiles can be created by repeated bending, and which shall be based upon a very simple construction and, in particular, shall require considerably less massive forms of construction for the punches and the frame than hitherto and thus lead to a considerable reduction in the total mass. Furthermore, the most careful possible handling of the sheets during bending is an objective.

The inventive sheet bending machine of the initially stated type is characterized in that the two bending punches are pivotally supported against each other or indeed supported in the frame, in the working region itself, at least at a plurality of positions distributed across the width of the bending device or indeed continuously, thus defining a common axis of pivoting.

In the bending device according to this invention, therefore, a support for the two bending punches is provided in the working region itself, a force action being provided through this support in the bending of sheets which results in an at least partial balancing, especially of the horizontal components of the forces in the hinge applied during bending, this being achieved, which is of importance, directly in the working region across the width of the bending device, with the result that, on the one hand, massive pivot bearings at the end faces of the bending punches and, on the other hand, massive constructions of the bending punches themselves can be rendered unnecessary. Experiments have shown that, in comparison with bending machines according to the state of the art of, for example, 15 tonnes, the same bending performance can be attained with a bending device constructed according to this invention having a total weight of approximately 2 tonnes, that is to say a reduction in the mass to 1/5–1/10 is possible.

By the invention, the advantage is also achieved that a careful, energy-saving bending operation at the metal sheet is made possible, and furthermore, because the counter-punch can without difficulty be constructed with a sharp lower edge, around which the metal sheet is bent, sharp and accurately defined bent edges can be produced by means of the bending punches supported in the working region.

To achieve a reliable movement guidance of the bending punches, in addition to their mutual pivotal support, it has been found especially advantageous for the two bending punches to be connected together in articulated manner by means of pairs of angle levers, provided at intervals across the width of the bending device, these pairs being each connected together by a hinge. An especially simple and robust construction can be achieved here if the angle levers are each, on the one hand, articulated to one of the bending punches and, on the other hand, are slidably guided by a slide block or the like in a slide groove of the other of the two bending punches.

The hinges by which the angle levers of a pair are connected to each other then move especially in the vertical, central plane of the bending device, in which also the aforementioned common pivot axis lies.

This central plane, is, in particular, also that plane along which the counter-punch is movable.

Another advantageous form of embodiment, in which force components can be fed directly into the frame in a favourable manner, is characterized in that the two bending punches are articulated to each other by shoes, which are guided in circular-arc guide tracks having the centre point in the region of the sheet bend, and, during the bending, are held by the linearly movable counter-punch in frictional connection with the sheet to be bent. It is advantageous here also that the sheet to be bent can be treated especially carefully on its surface, because relative movements between the sheet and the bending punches in the plane of the sheet surface can be avoided. By the articulated mounting of the bending punches, their surface of attack on the sheet can be retained during bending, thus making an especially high surface quality achievable.

Yet another advantageous form of embodiment, in which a direct balancing of the contrary horizontal force components in the region of the bending zone is made possible, is characterized in that the two bending punches are connected together in the manner of a hinge directly in the working range along the edges facing one another in the at-rest position.

It has, furthermore, proved advantageous if the counter-punch can be secured in its working position, brought up against the surface of the sheet to be bent, and thus forms a stationary counter-punch during bending.

For example, during multiple bending of a sheet, in order to avoid as far as possible interference by the counter-punch against which the multiple-bent sheet strikes, it is furthermore advantageous if the counter-punch is pivotally journalled about an axis extending generally in the vicinity of the bending edge of the sheet on a support guided up and down on the frame. With such a form of construction, it is possible for the counter-punch to pivot away sideways in the last phase of the bending operation if the multiple-bent sheet strikes it. The counter-punch can here be mounted freely pivotal, or it may be connected to a pivoting drive, which for example is activated by a microswitch, against which the sheet strikes.

One form of embodiment which may be preferred with regard to the construction of the stationary part of the bending device in specific cases (for example on account of the stationary fixing of a part of the sheet during bending), is furthermore characterized in that the one bending punch is mounted stationary and the other bending punch and also the counter-punch are pivotally journalled, the pivotally mounted punch being drivable at twice the angular speed of the counter-punch.

In all cases the bending punches, like the counter-punch, may cheek-shaped.

It is furthermore favourable, for a smooth running of the bending operation and in order to achieve the desired sharp bent edges, if the horizontal pivot axis of the counter-punch coincides, in its operating position, at least substantially with the common pivot axis of the bending punches.

It would, basically, be conceivable to equip the counter-punch with an eccentric drive, as described for example in WO 81/02535, but it has been found that a simple spindle drive may be associated with the counter-punch for the up and down movement in the present bending device. With such a spindle drive, the aforementioned arresting of the counter-punch in the working position can be achieved without problems by simply stopping the spindle.

It is advantageous, in order to achieve the pivoting of the punches in the simplest possible manner, to provide a plurality of rack-and-pinion drives or power cylinders, distributed across the width of the device, as the pivoting mechanism. The rack-and-pinion drives are then preferably arranged symmetrically and in particular are coupled to one common drive motor.

An advantageous form of embodiment is here, furthermore, characterized in that several racks are articulated to each bending punch and mesh with pinions mounted on a shaft, so that the bending punches can be driven in a simple manner at several points simultaneously.

In order to simplify the drive mechanism, it is furthermore favourable if, on the two shafts associated with the two bending punches, two pinions meshing with each other are provided, so that the shaft driven by the drive motor drives the other shaft in the opposite direction.

In the bending of smaller sheets it may be advantageous, having regard particularly to the desired sharp, exactly defined bending edges, if the bending punches (19, 20) are shaped, at their end (40) facing towards the counter-punch (10), in cutting edge-like manner, with a convex curvature.

Having regard to the desired reduction of the masses, it is also of especial advantage if the two bending punches are pivotal independently of each other, the pivoting drives preferably acting on the punches in distributed manner across the width of the device, and the counter-punch being only linearly movable.

In multiple bending it happens, as already mentioned, that the sheet to be bent, when a second or third bend is being produced, strikes with an already bent, cranked region against the counter-punch (so-called "collision" case). A remedy, as referred to above, is possible here by the counter-punch being arranged to swing away. For this purpose, however, a pivotal mounting of the counter-punch is necessary, in which case both the pivot bearings and also the punch itself must be appropriately dimensioned to enable the counter-force to be applied during bending of the sheet. Frequently, therefore, the objective is to achieve the simple linear mobility of the counter-punch which, although not absolutely necessary, nevertheless is preferred, and in order to create a deflection possibility for the sheet in the aforementioned "collision" case and to make possible further bending after the sheet has struck the counter-punch, it is especially favourable according to this invention if independent pivot drives are associated with the two bending punches. By means of the independent pivot drives, it is then possible simply to stop the one bending punch in the collision case so that, on that side of this punch where the already bent side of the sheet is situated, the sheet is then simply held, whereas the other bending punch continues to pivot in order to bend the sheet further. With this asymmetrical method of operating also, at least a large part of the horizontal components of the bending forces are compensated by the hinged connection, so that only relatively small force components are introduced into the bending punches and from them into the frame.

As a consequence of the stated articulated connection, the present bending device is suitable for especially extreme bending operations, and it is especially advantageous if the counter-punch can be retracted from the sheet in the last phase of bending in order to make possible a folding of the sheet.

For a careful handling of the sheets during bending and also to achieve an optimum force transfer at the commencement of the bending work, it has also been found favourable to provide a depression in the bending punch between the, for example convex, possibly flattened sheet contact zone of each bending punch and the hinge-like articulated connection, the hinge axis then being offset somewhat from the plane of bearing against the sheet.

To make a rapid conversion of the bending device possible, for which in particular different working widths must be achievable, it is furthermore of advantage for the bending punches to be provided with removable tool segments, disposed alongside one another across the width of the bending device. In this connection it is advantageously possible in the present bending device, in view of the articulated connection between the bending punches, for the tool segments to be attached, at the side remote from the metal sheet contact zones, to the remainder of the bending punches functioning as tool holders, by means of a simple push-in connection, e.g. tongue-and-groove connection.

One constructionally advantageous form of embodiment is furthermore characterized in that the tool segments are connected together in pairs like hinges, the articulated connection of the bending punches being formed by the hinge connections of all the tool segment pairs. It is furthermore of particular advantage, for facilitating assembly and also replacement, if the tool segment pairs are provided with their own hinge pins, adapted to the length of the segment. To hold the adjacent tool segments to one another, it is furthermore favourable for the tool segment hinge pins each to project on one side into the hinge eye of the adjacent tool segment pair. When a tool is to be changed, then for example all the hinge pins that are aligned with one another are displaced linearly together by the dimension by which they each project into the adjacent segment, until the segments are no longer held to one another.

To make possible replacement for the wear that occurs in normal operation, it is furthermore also favourable for the bending punches, or possibly the tool segments, to be provided with separate inserts which form the sheet contact zones. These inserts can then be screwed to the bending punches or tool segments.

An especially advantageous and effective drive possibility has been found to be the provision of a circular arc-shaped toothed rack or rail as pivoting drive for the bending punch or each bending punch, this rack or rail being firmly fixed to the associated bending punch and being driven by a pinion mounted on a shaft. It is furthermore favourable if the circular arc-shaped toothed rack or rail is mounted in a circular arc-shaped bearing, e.g. bearing groove, on a stationary bearing component. In this manner the relevant punch can be mounted on the frame of the bending device by means of the toothed rails. It is also advantageous for two separate electric motors to be provided for the rotating drives of the two shafts associated with the bending punches.

SHORT DESCRIPTION OF THE DRAWINGS

The invention is explained in further detail below by reference to especially preferred examples of embodiment, illustrated in the drawing, although it is not limited to these embodiments. The Figures in the drawing show:

FIG. 1 a schematic, perspective view of a sheet bending device according to this invention in the at-rest position;

FIG. 2 a corresponding schematic, perspective view of this sheet bending device, the opposite side being visible;

FIG. 3 a perspective view corresponding to FIG. 1 of this sheet bending device in a working phase, in which bending of the sheet is being started;

FIG. 4 a corresponding illustration of this sheet bending device, in which the sheet to be bent is already largely bent;

FIG. 5 a further illustration of this sheet bending device, but now at the end of the bending operation;

FIG. 6 a highly schematic, partly sectioned end elevation of the essential working components of the sheet bending device in the atrest position corresponding to FIG. 1;

FIG. 7 a corresponding schematic end view of these working components of the sheet bending device, but now corresponding to the illustration in FIG. 2 at the commencement of the bending operation;

FIG. 8 a corresponding end elevation of these working components corresponding to the view of FIG. 4, with the sheet almost completely bent;

FIG. 9 in a corresponding end view, the working components of the sheet bending device at the end of the bending operation, in a working phase corresponding to FIG. 5;

FIGS. 10 and 11, each highly schematic end views of bending tools for bending different thicknesses of sheet, in each case the phase at the start of the bending operation and at the end of this operation being illustrated;

FIG. 12 in a schematic end view corresponding to FIG. 9, a form of embodiment of the bending device having modified lower bending punches;

FIG. 13 a schematic partial view of a further modified lower bending punch;

FIG. 14 a schematic cross-section through the upper part of the one lower bending punch, e.g. that to the left in FIG. 6, on the line XIV—XIV in FIG. 15, for the purpose of illustrating bearing recesses and slide or guide grooves in the bending punch;

FIG. 15 a partial view of the inner face of this lower bending punch, substantially in the direction of arrow XV in FIG. 14;

FIG. 16 an axonometric illustration of a double angle lever assembly for the articulated connection of the lower bending punches;

FIG. 17 a sectional view similar to FIG. 14, but now with a double angle lever assembly, on the line XVII—XVII in FIG. 18;

FIG. 18 an elevation, partly in section, on the line XVIII in FIG. 17;

FIGS. 19 to 21, sectional views similarly to FIGS. 14 and 17, but now comprising the two lower bending punches and also the double angle lever assembly, for the purpose of illustrating different phases during the pivoting of the lower bending punches;

FIG. 22 a schematic, perspective view of the arrangement of the punches of a further, modified bending device;

FIGS. 23, 24 and 25, in schematic end views similarly to FIGS. 10 and 11, various phases in the bending of sheet with a bending device according to FIG. 22, FIG. 23 showing the starting position, FIG. 24 an intermediate position and FIG. 25 the final position;

FIG. 26 a schematic end elevation, generally corresponding to that of FIG. 7, of yet another bending device, the starting position of the bending tools being shown in solid lines and an intermediate position in broken lines;

FIG. 27 a perspective overall view of a further form of embodiment of the sheet bending device according to the invention in the at-rest position;

FIG. 28 a perspective, partial view of a portion of this bending device in the region of the bending tools, in a working position, to a larger scale than FIG. 27;

FIG. 29 a schematic end view of the main components of the bending device according to FIGS. 27 and 28;

FIG. 30 in an exploded view, a pair of tool segments with a hinge joint for the bending punches of the bending device according to FIGS. 27 to 29;

FIGS. 31, 32 and 33, in schematic end views, the bending tools and a sheet to be bent in various phases of the bending operation;

FIG. 34 an end view of one of the bending punches of the bending device according to FIGS. 27 to 33, but in an embodiment differing from FIGS. 27 to 33; and FIG. 35 a form of embodiment modified from FIG. 34 in a corresponding end elevation.

DETAILED DESCRIPTION OF THE PREFERRED FORMS OF EMBODIMENT

Figure 1:
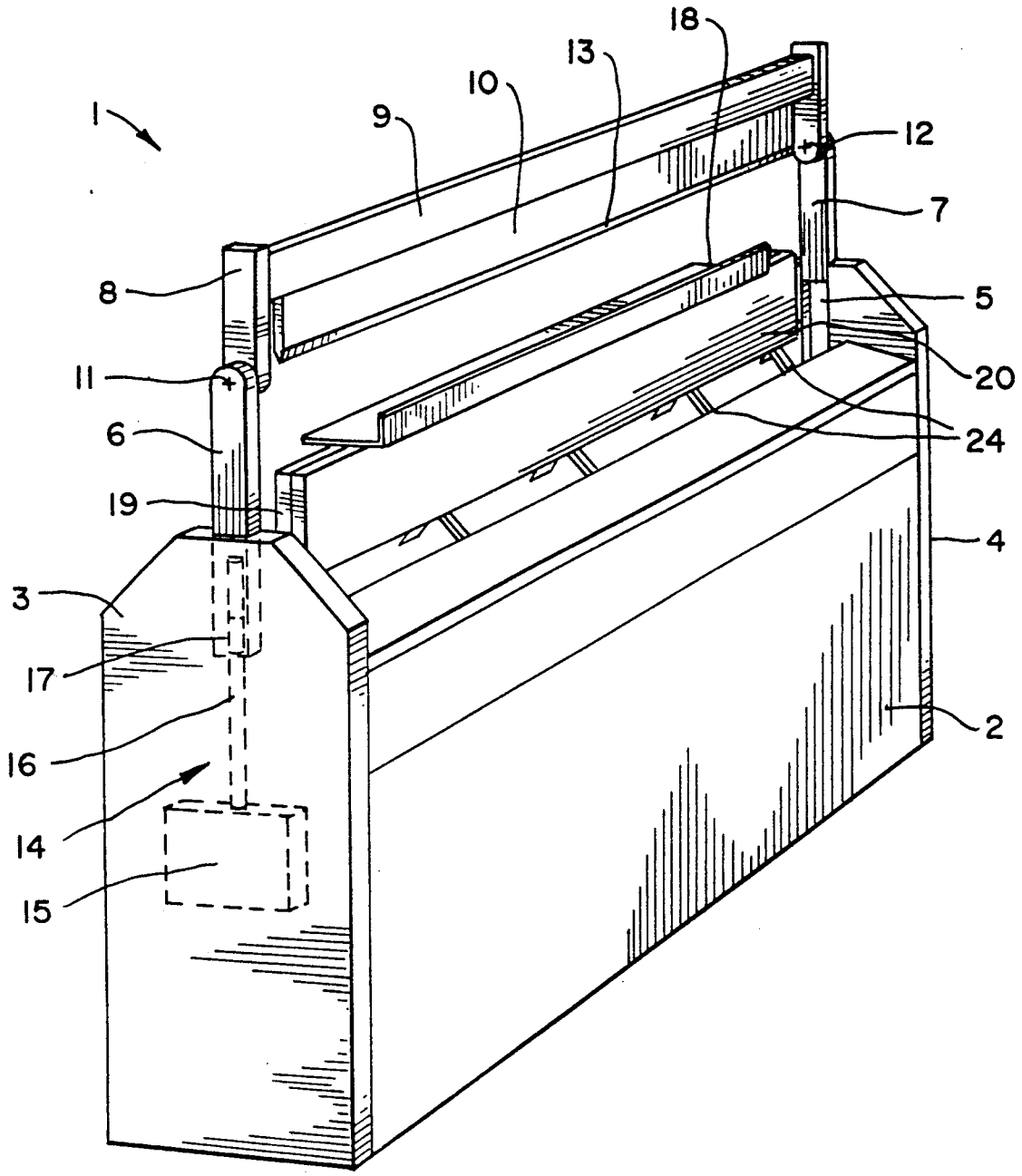

According to FIGS. 1 to 5 and 6 to 9, the present sheet bending device or bending press referenced generally 1 has a lower frame 2, on which vertical guides 5 are provided in main end supports 3, 4, column-shaped supports 6, 7 being slidable vertically up and down in these guides. These supports 6, 7 carry an upper mounting support 8 comprising a cross-head 9, to which an upper web-shaped or sword-shaped counter-punch 10 (hereinafter termed also upper tool, upper bending tool or upper (bending) punch) is replaceably attached, the mounting support 8 for the counter-punch 10 being freely pivotally journalled on the supports 6, 7 in conventional pivot joints 11, 12, illustrated only schematically. The purpose of this pivotal mounting will be explained below in more detail with reference to FIGS. 5 and 9 respectively.

The pivot axis determined by the pivot joints 11, 12 of the mounting support 8 on the supports 6, 7 runs preferably along the knife-shaped, lower bending edge 13 of the upper counter-punch 10.

For raising and lowering the upper counter-punch 10, conventional spindle drives, for example, are connected to the supports 6, 7, as shown in FIG. 1 very schematically at 14. These spindle drives 14 contain spindles 16 driven, for example, by a drive motor 15, possibly via a gear and a clutch (not shown), these spindles cooperating with a spindle nut 17 provided at the lower end of the supports 6,7, in order to move the supports 6, 7 up and down in their guides 5 as the spindles 16 revolve. These spindle drives 14 and further drive devices, still to be explained, are housed in conventional manner on or in the frame 2.

Figure 26:
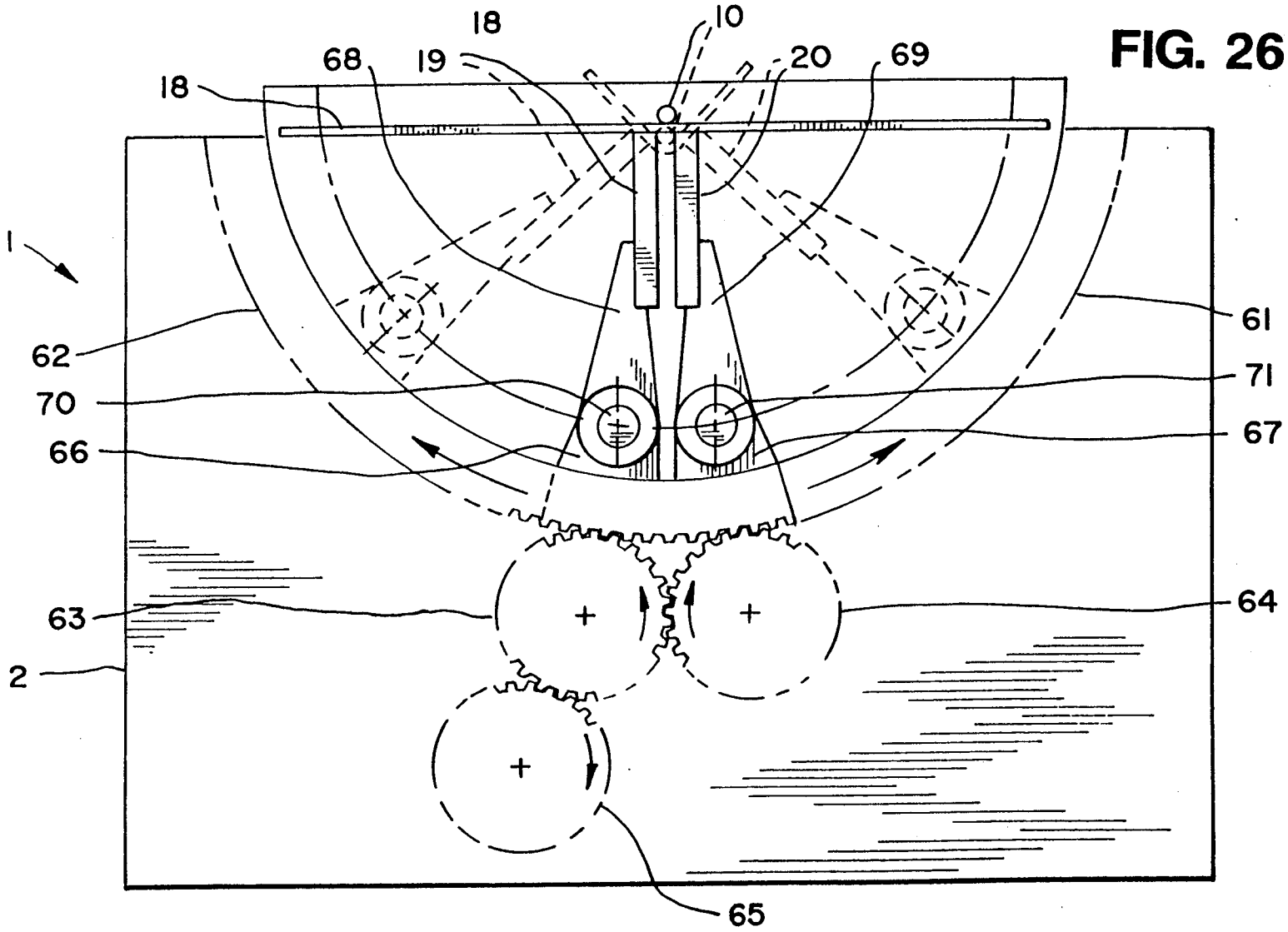

For bending a sheet 18, two lower, especially plate-shaped or cheek-shaped bending punches 19, 20 (also termed lower tools, lower bending tools or simply lower punches) are provided on the frame 2. These two lower bending punches 19, 20 are pivotally journalled to one another and to the frame 2 at the main supports 3, 4, in a manner not shown in more detail in FIGS. 1 to 9, e.g. by double lever assemblies or cam guides. An example of an articulated assembly comprising double lever assemblies for the moving guidance of the two lower bending punches 19, 20 during pivoting is explained in more detail below by reference to FIGS. 14 to 21. Another example is shown in FIG. 26, and a further possibility is illustrated in FIG. 22 and FIGS. 27 to 35.

The two lower bending punches 19, 20 are pivotal at least substantially about a common pivot axis 21 (see for example FIG. 7 and 8), which lies in the region of the bent edge 22 to be produced in the plate 18 to be bent, and which lies especially also in the plane 23 of the upward and downward movement of the upper counter-punch 10. The common pivot axis 21 coincides preferably also with the axis defined by the pivot joints 11, 12 for the pivoting of the upper punch 10 together with its mounting support 8 relative to the supports 6, 7 when the upper punch 10 is situated in its working position according to FIGS. 3 to 5 and 7 to 9, in which it serves as a stationary counter-tool during bending. In this connection it should also be pointed out that, in the schematic illustrations according to FIGS. 6 to 9 and also that according to FIG. 12, the vertically movable supports 6, 7 have been omitted and only the mounting support 8 with upper punch 10 and the pivot joints 11, 12 are schematically shown.

Figure 6:
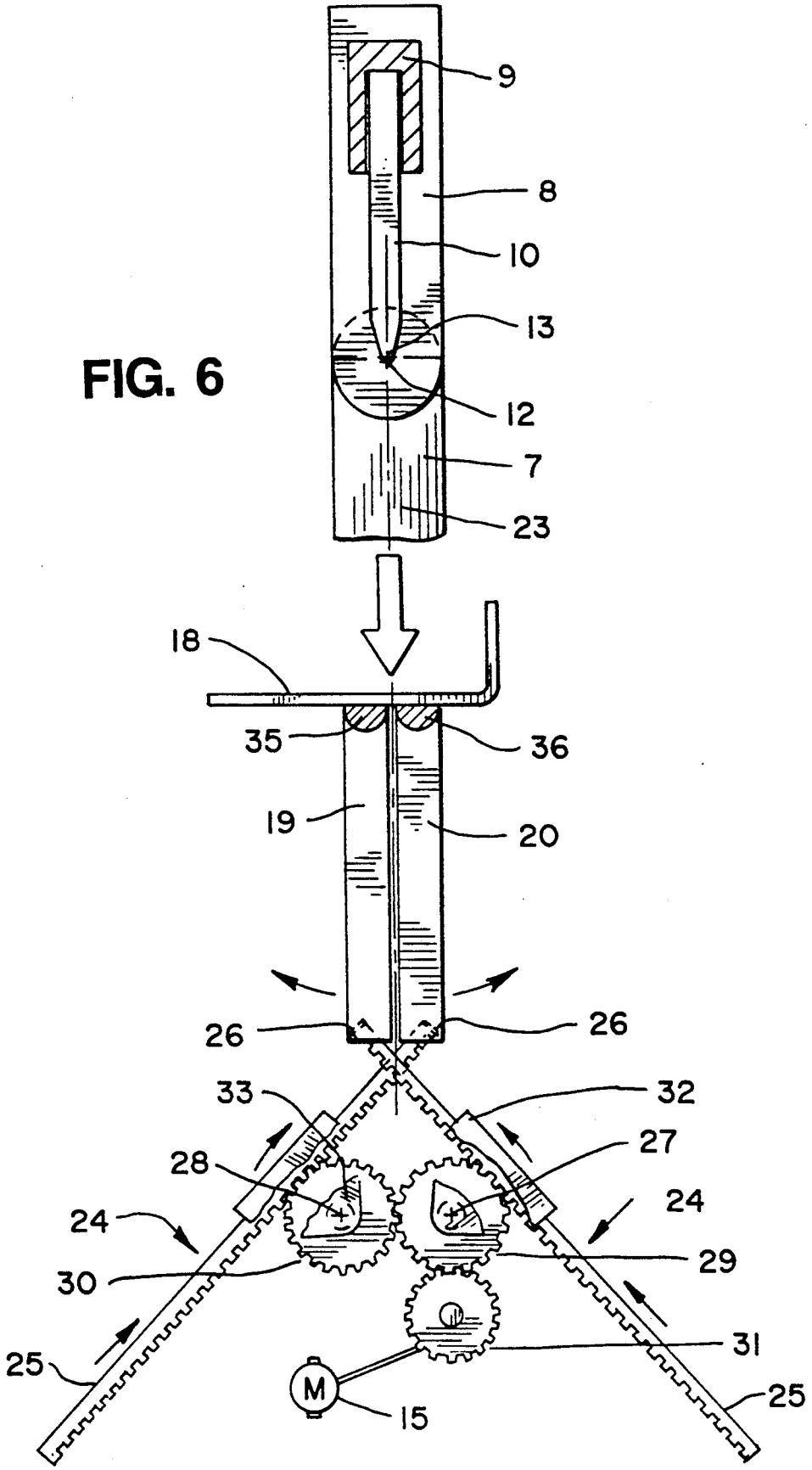
Figure 7:
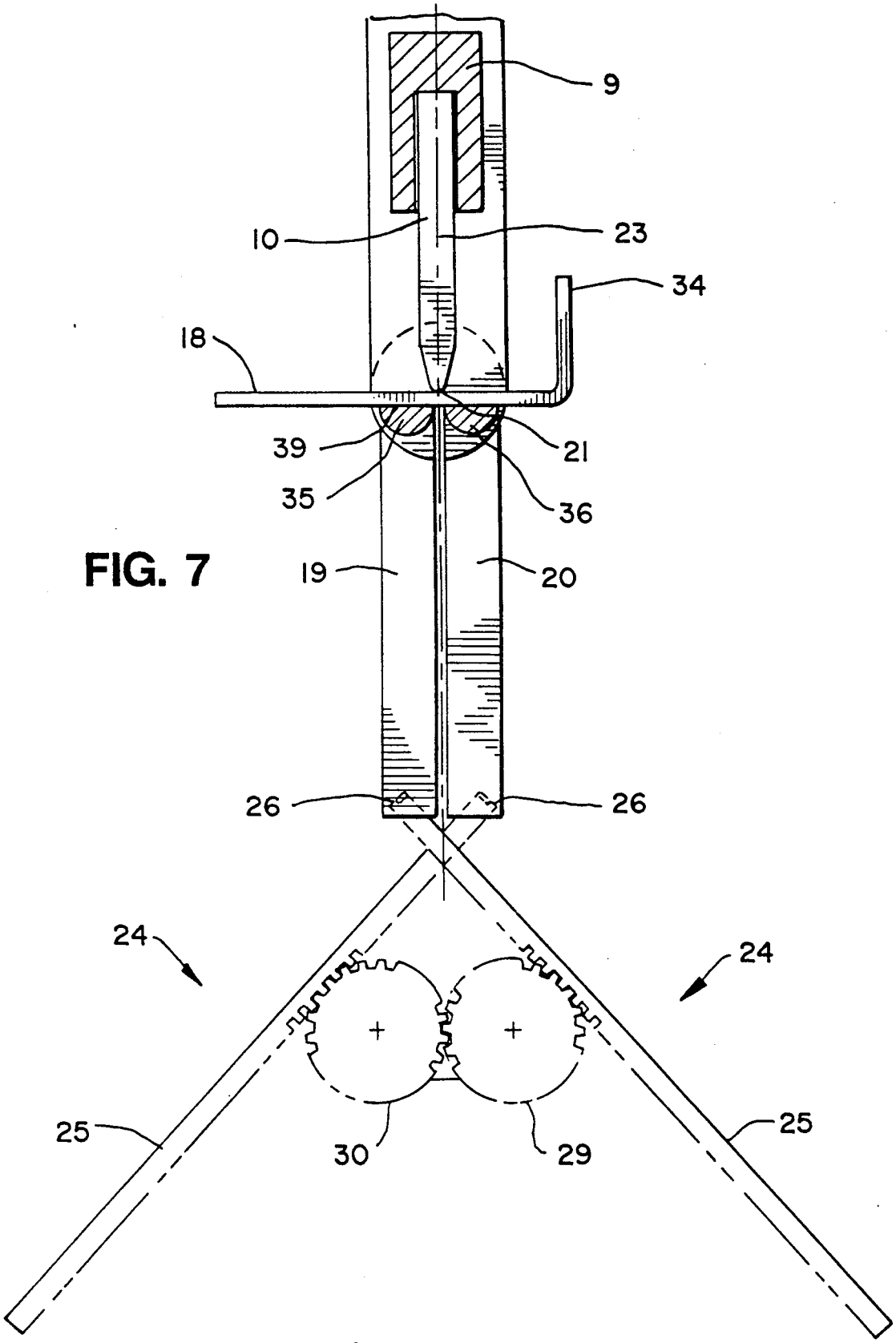
Figure 8:
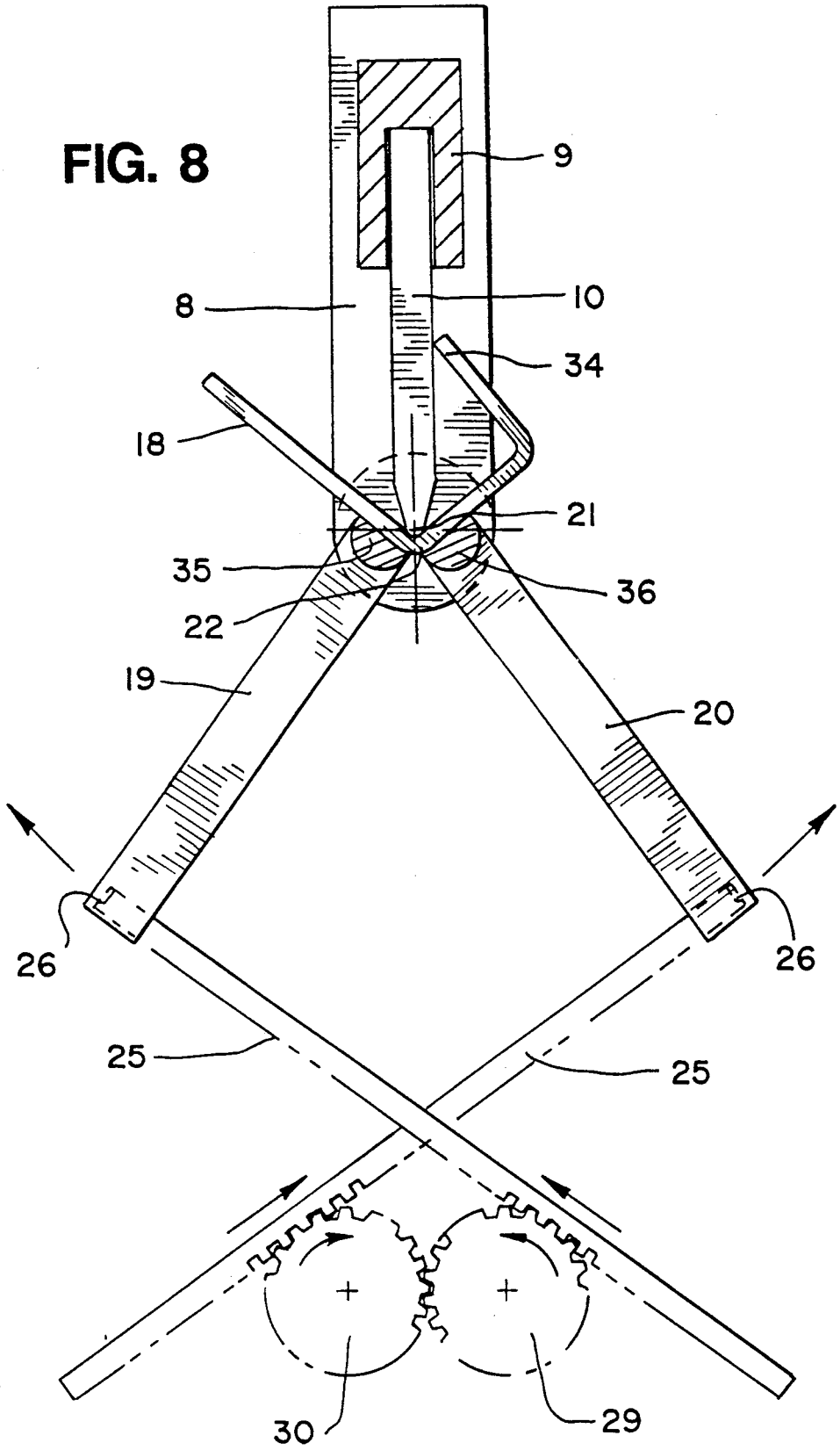

The plane in which the upper punch 10 moves up and down is referenced 23 in FIGS. 6 to 8.

As a drive for pivoting the lower bending punches 19, 20 about the common pivot axis 21, a pivoting mechanism is used which, in the present example of embodiment, contains a plurality of toothed rack drives distributed over the width of the bending device 1 and indicated schematically in FIGS. 1 to 5 at 24. In more detail of each, a toothed rack 25, e.g. rectilinear rack, is articulated in the lower region of the relevant lower bending punch 19, 20 respectively, as shown schematically in FIG. 6 at 26. These toothed racks 25 mesh with pinions 29, 30 respectively, of equal size, seated on shafts parallel to each other and to the bending punches 19, 20 (these shafts are indicated in FIGS. 6 to 9 by their geometric axes 27, 28 respectively). The one shaft, e.g. 27, is driven by a drive motor, preferably the sole, common drive motor 15, which also drives the spindle drives 14 for the upper counter-punch 10, as indicated schematically in FIG. 6, it being possible if desired for a gear indicated symbolically by a pinion 31 in FIG. 6 to be incorporated between, as may also be provided in the case of the spindle drive 14 (not shown).

The two shafts 27, 28 extend over the entire width of the bending device 1, and they are journalled at their ends and also, possibly, at intermediate points between the individual rack-and-pinion drives 24, in appropriate bearings, (not shown) in the frame 2. Each rack drive 24 comprises a toothed rack 25 and a pinion 29, 30 respectively, keyed onto a corresponding shaft 27, 28 respectively. When the shafts 27, 28 are driven in rotation, the straight toothed racks 25 are therefore displaced along their length, thus pivoting apart in a symmetrical splaying movement the lower bending punches 19, 20, articulated to them, see especially the illustrations in FIG. 7 (at-rest position) and 8 (pivoted apart working position). In order to make possible the slight pivotal movement required for this purpose of the toothed racks 25 about the shafts 27, 28, the racks 25 can be seated and guided in tubular casings 32, as shown in FIG. 6 schematically, this casing 32 being freely pivotally journalled by flange portions 33 on the relevant shaft 27, 28 respectively. The toothed pinions 29, 30 here pass through slit openings parallel to the longitudinal axis of the rack 25 into the tubular casing 32, to enable them to mesh with the racks 25 housed there.

The method of functioning of the above-described sheet bending device 1 is now explained by reference to the schematic illustrations of FIGS. 6 to 9 and also with reference to FIGS. 1 to 5 and furthermore to FIGS. 10 and 11.

Figure 2:
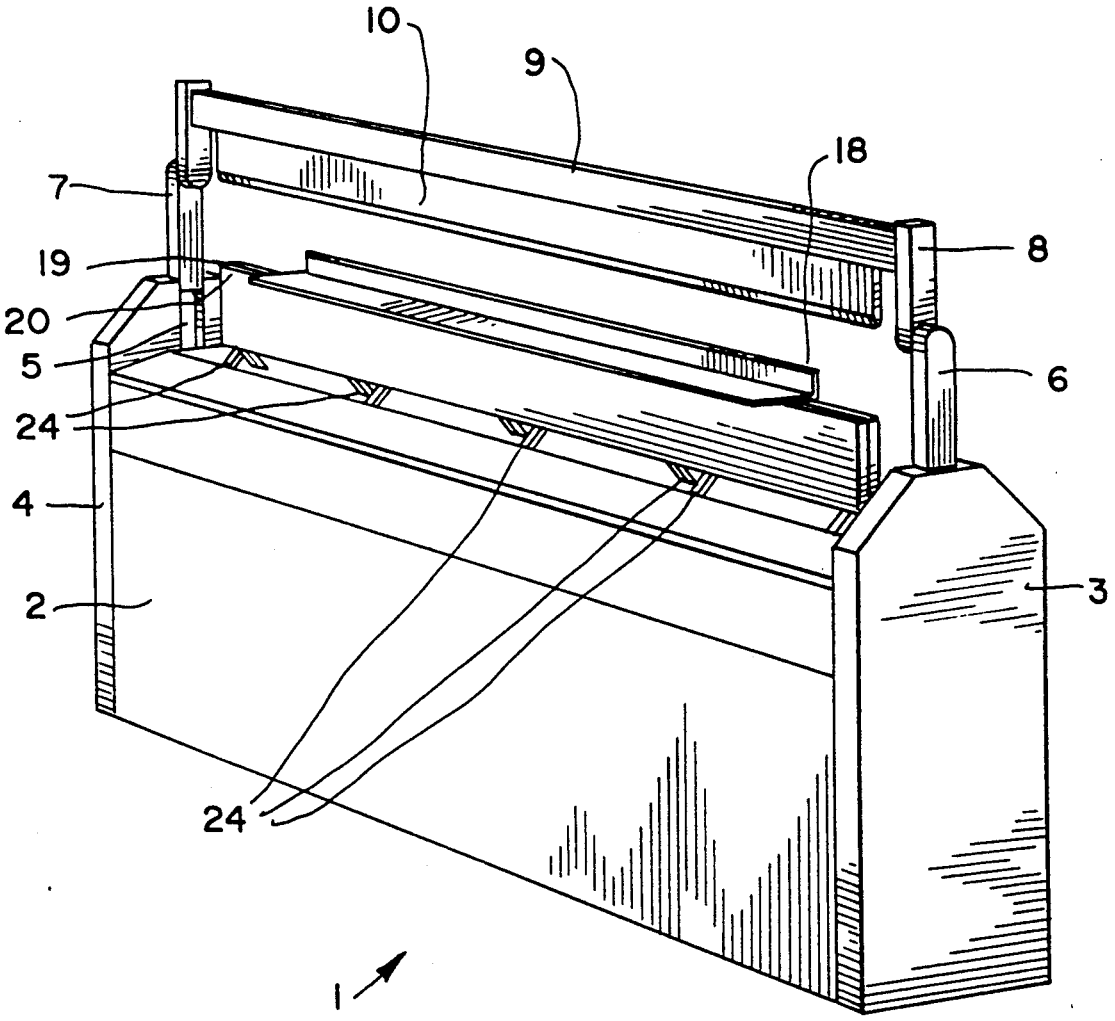
Figure 3:
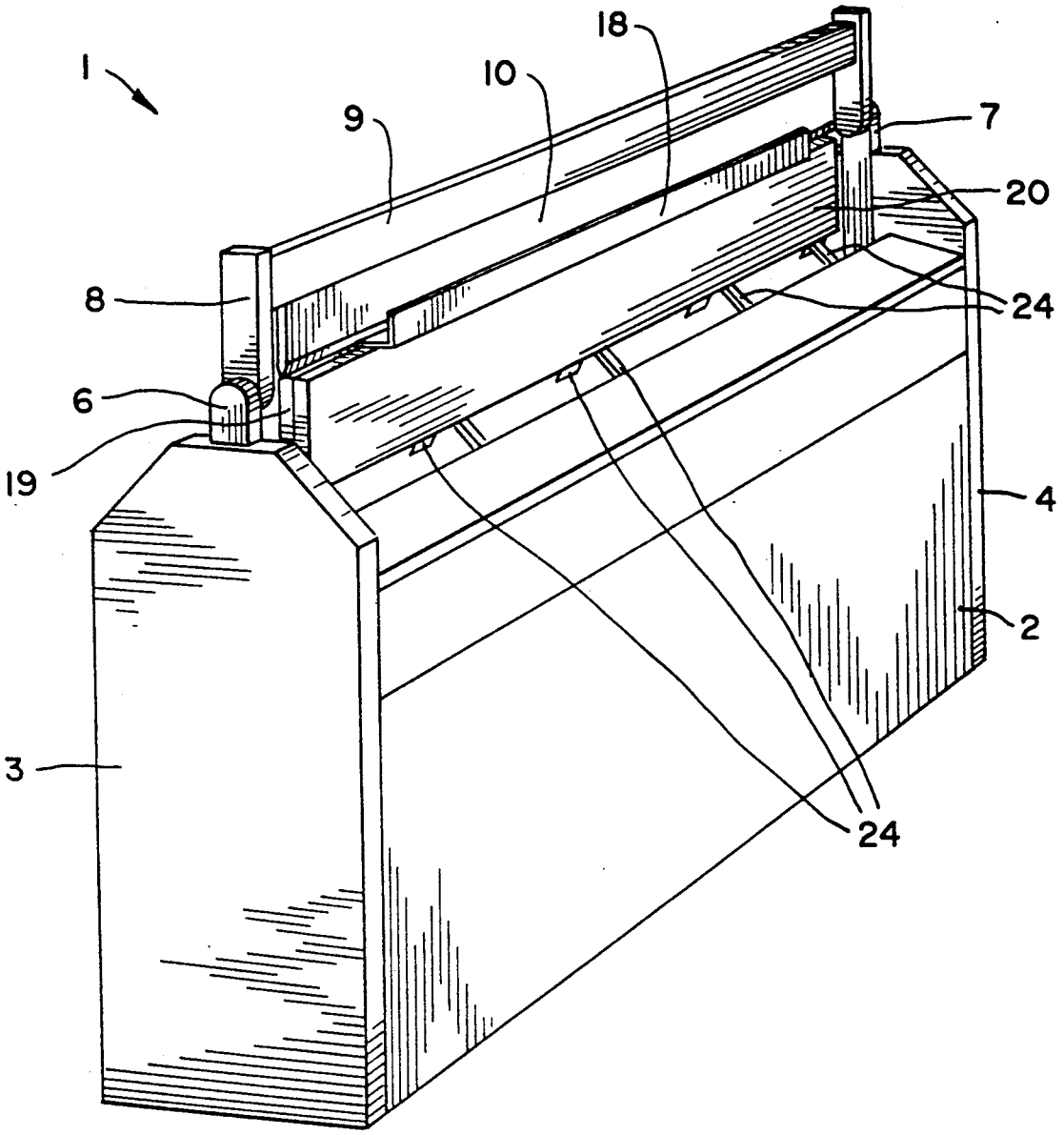
Figure 4:
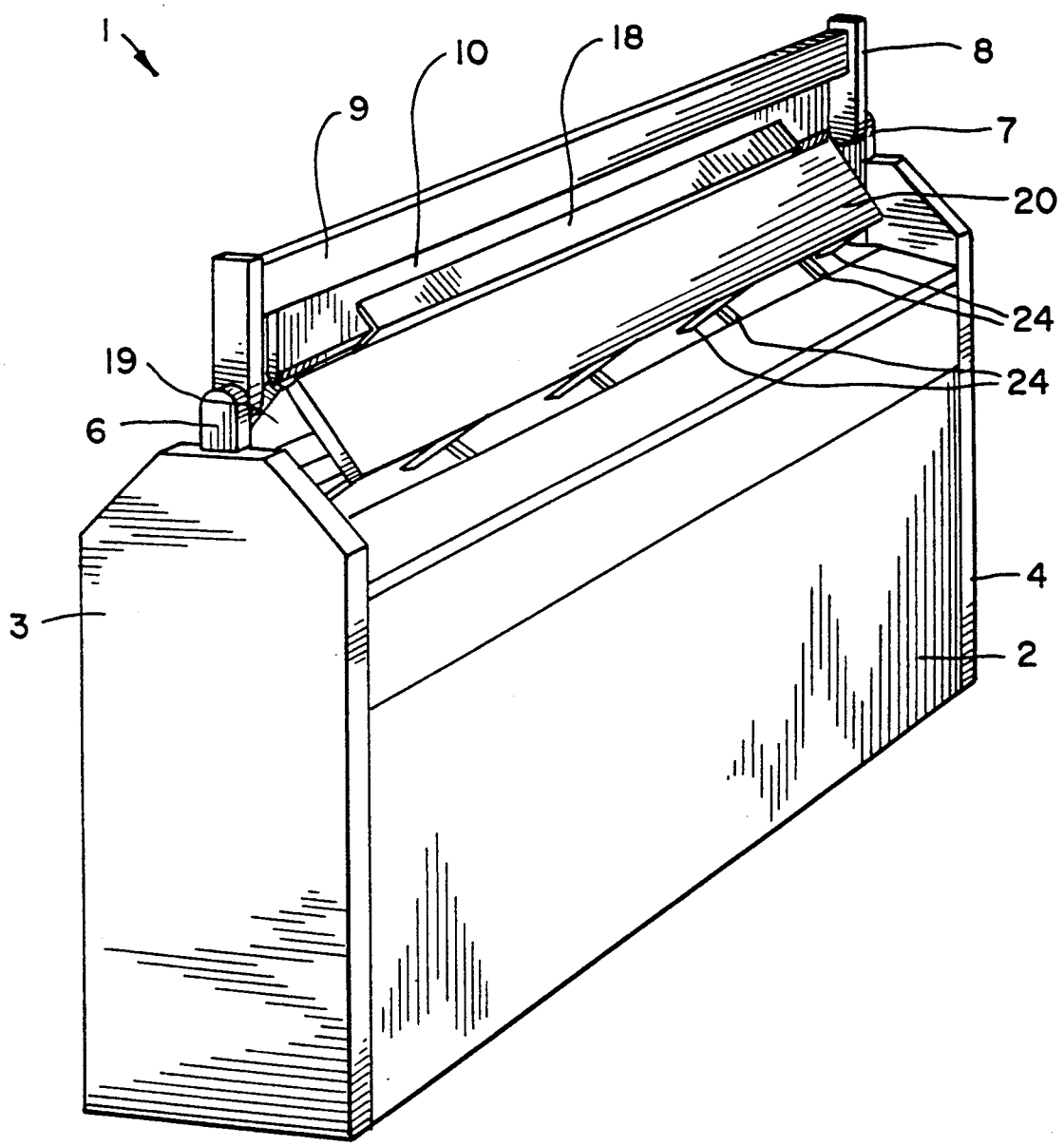

The starting or at-rest position of the sheet bending device 1 is shown in FIGS. 1, 2 and 6. The upper counter-punch 10 here adopts its upper, at-rest position raised off the sheet 18, and in this position a sheet 18 to be bent can be fed by hand or mechanically to the bending device 1 and brought on it into position. If a sheet bending cycle is now commenced, the upper punch 10 together with its mounting support 8 is first moved downwards in the guides 5 by means of the supports 6, 7, until the upper counter-punch 10 touches, with its edge 13 (which especially is in alignment with the axis 11, 12), the sheet 18 to be bent, which previously has been brought onto the lower bending punches 19, 20. This phase, in which the sheet 18 is virtually clamped between the three punches 10, 19 and 20, but is not yet being bent, is illustrated in FIGS. 3 and 7 and also in full lines in FIGS. 10 and 11.

The drive to the drive shafts 27, 28 of the rack-and-pinion drives 24 for the lower bending punches 19, 20 are now closed, that is engaged, for example by means of a clutch, not further illustrated. Accordingly the toothed racks 25 are driven upwards symmetrically obliquely in pairs, the lower bending punches 19, 20 pivoting in opposite directions about their common pivot axis 21, i.e. according to the view in FIGS. 7 and 8 the left bending punch 19 pivots clockwise and the right bending punch 20 counter-clockwise. By means of the pivoting, lower bending punches 19, 20, the sheet 18 is symmetrically bent by bearing against the lower edge 13 of the upper counter-punch 10, thus producing the bent edge 22. During this bending operation, the upper counter-punch 10 together with its mounting support 8 is favourably held or stopped in its position, for example by means of the spindle drive 14 (FIG. 1), so that it forms a stationary counter-punch in this bending operation. The sheet 18 is thereby bent, for example through approximately 90°, along the bending edge 22, see the views in FIGS. 4 and 8; as illustrated further in FIGS. 10 and 11, in this bending operation even an acute angle of bend can be created in the sheet 18, as indicated by the position of the lower bending punches 19, 20, shown there is broken lines.

Figure 5:
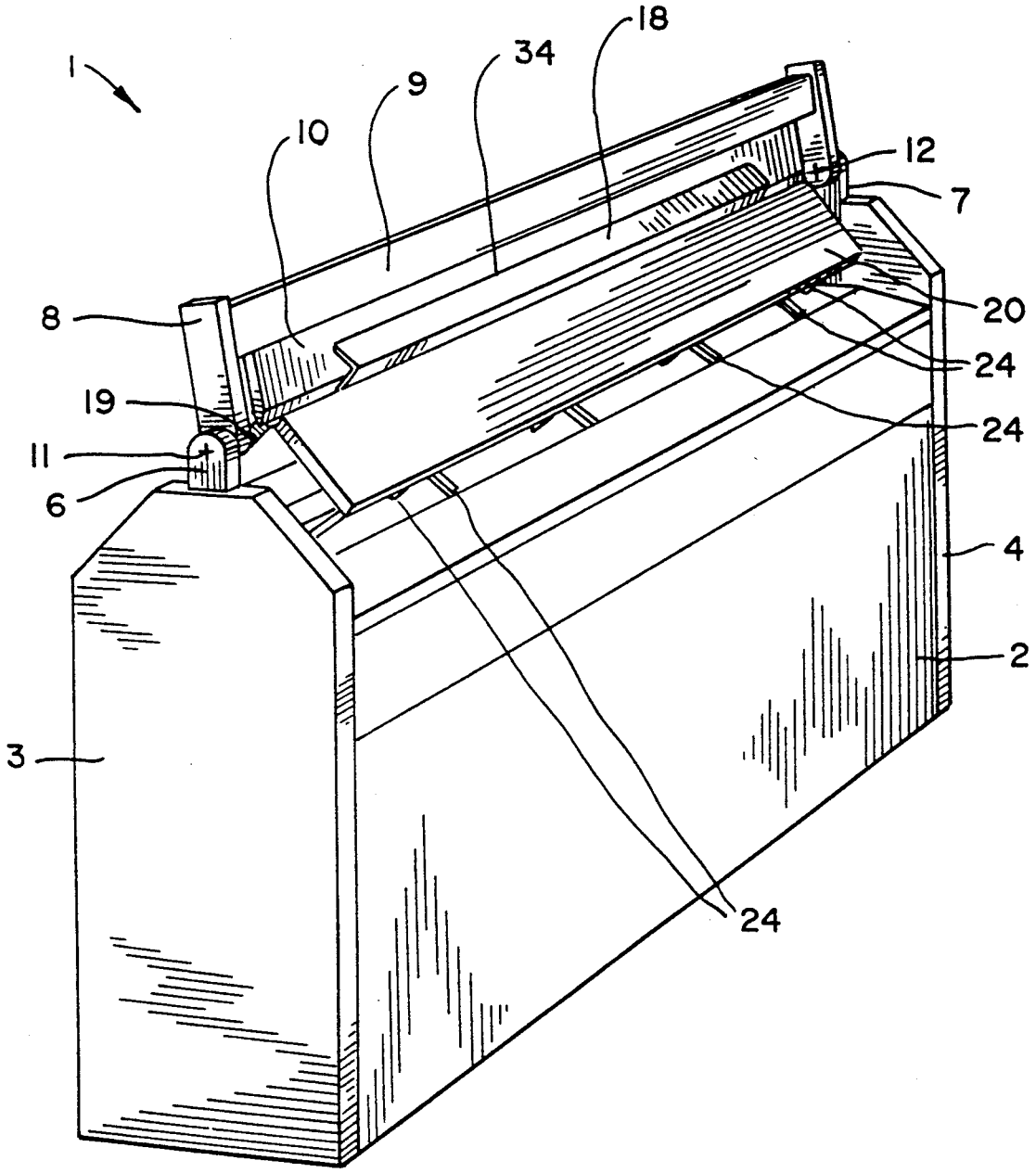
Figure 9:
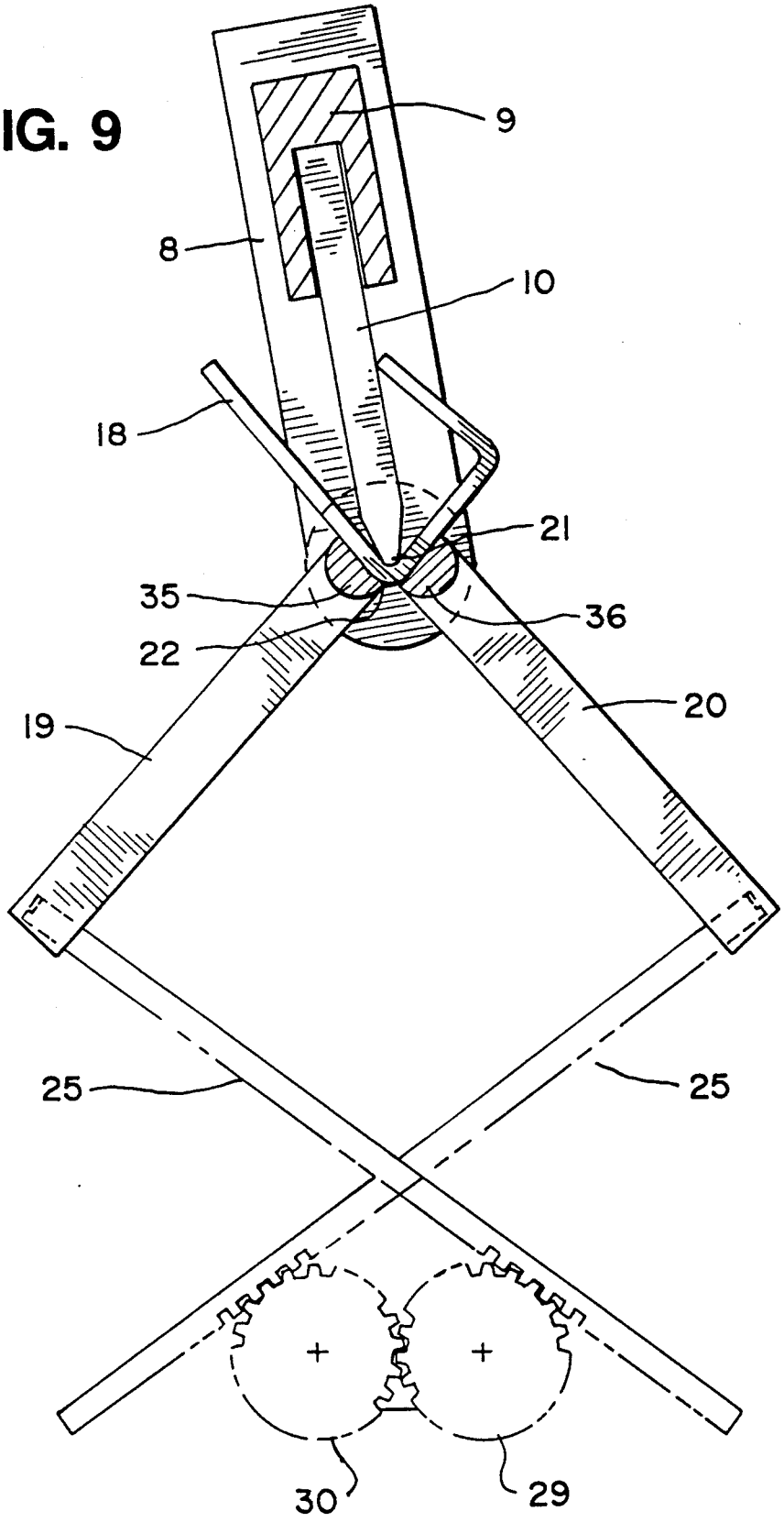

According to FIGS. 5 and 9, in the present sheet bending device 1, if the sheet 18 has already been subjected to a bending operation, the upper counter-punch 10 together with its mounting support 8 can be pivoted sideways about the axis defined by the articulations 11, 12 (FIG. 1), which as already mentioned coincides substantially in the working position with the bending axis or pivot axis 21 of the lower bending punches 19, 20, in order thereby to make room for the already bent-over edge 34 of the sheet 18.

The bending operation is thereby completed, and the drives are reversed, to pivot the lower bending punches 19, 20 back into the vertical starting position and to displace the upper counter-punch 10 upwards and again bring it upright. The bent sheet 18 can now be displaced forwards by a step or be removed from the bending device 1.

Figure 10:
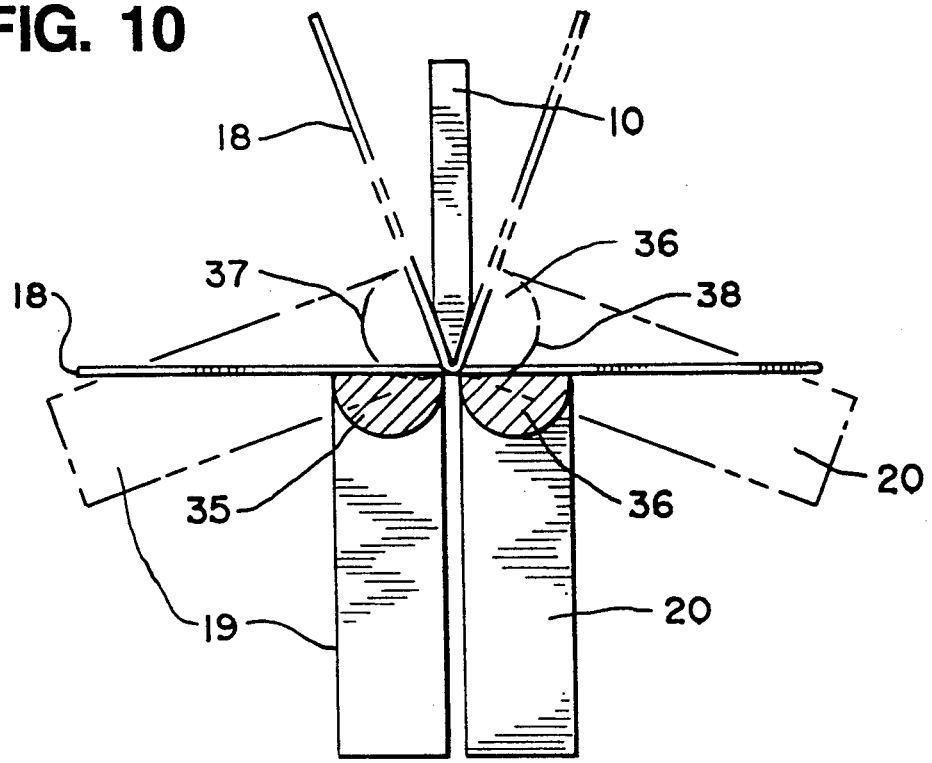
Figure 11:
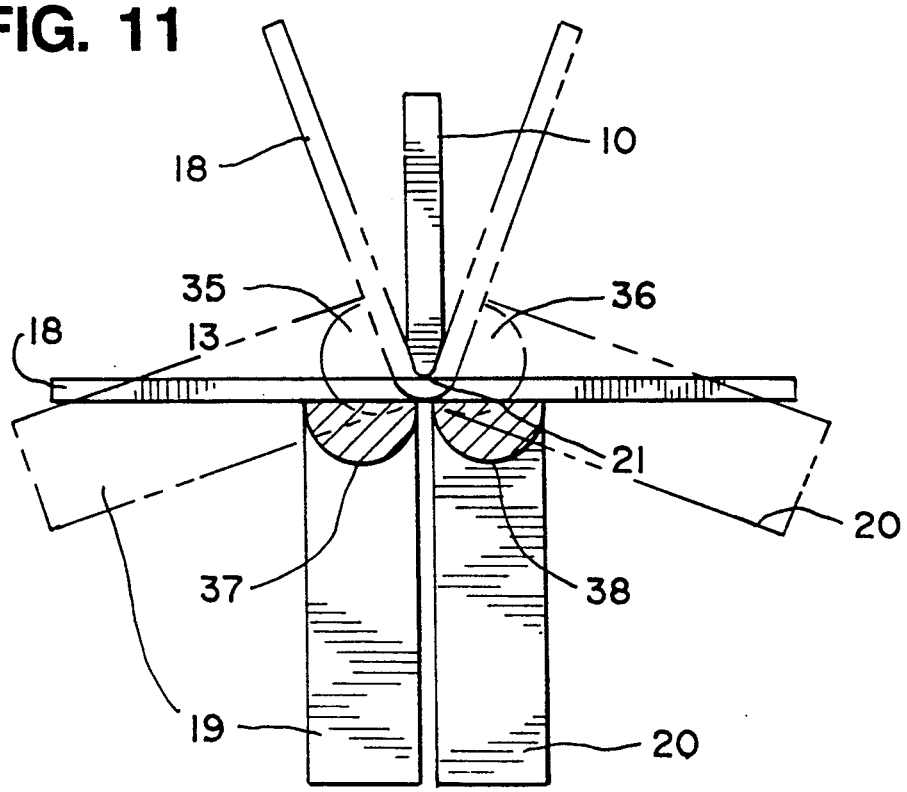

As can be seen from FIGS. 6 to 9 and also especially from FIGS. 10 and 11, the lower, pivotal bending punches 19, 20 may be provided at their end which is uppermost in the at-rest position with rod-like pressure members 35, 36, approximately semi-circular in cross-section, which are freely pivotally journalled in a semi-cylindrical bed 37, 38 respectively (FIGS. 10 and 11) at the upper ends of the lower bending punches 19, 20. With this form of construction, comprising the pivotal pressure members 35, 36, which have a flat surface 39 facing towards the sheet 18 to be bent, an adaptation to the particular sheet 18 is possible in a simple manner, especially for sheets of different thicknesses.

Figure 12:
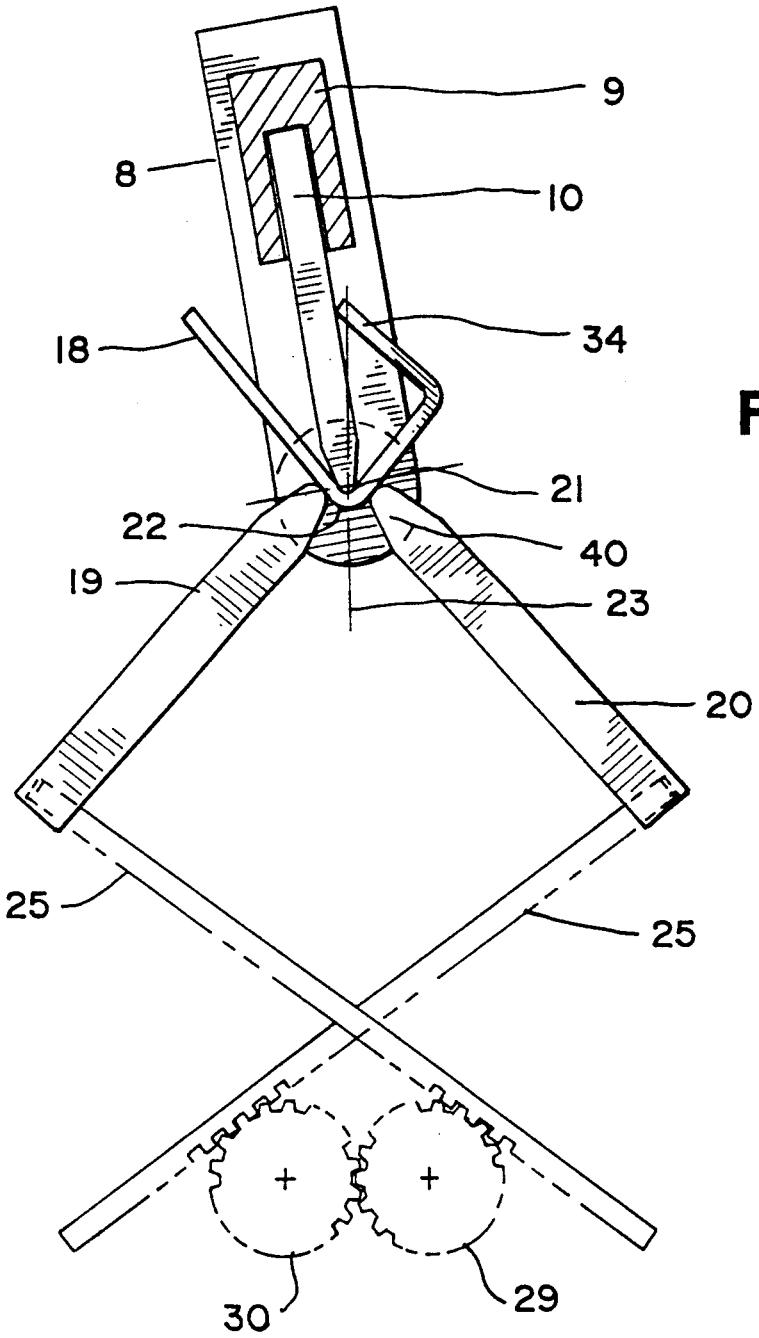

The lower bending punches 19, 20 may, however, instead also be provided with a knife-like upper edge having a convex rounded form, as shown in FIG. 12 at 40. In other respects this form of embodiment corresponds to the device so far described, and in particular the illustration in FIG. 12 corresponds to the illustration in FIG. 9, that is to say the final condition after a bending operation, with the upper counter-punch 10 pivoted to the side, is shown here, and therefore a new explanation corresponding to that given already with respect to FIGS. 1 to 5 and 6 to 9, is unnecessary.

Figure 13:
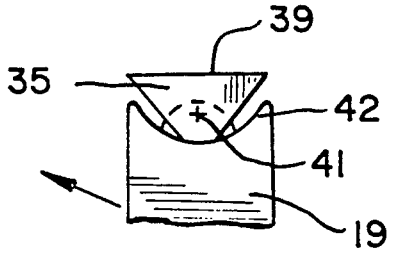

In FIG. 13, a further form of embodiment of the lower bending punch, e.g. of the punch 19, is shown in a schematic partial view. Here again, a pressure member 35 having a plane upper face 39 is pivotally journalled on the upper end of this bending punch 19. Here, illustrated schematically as an example, end pivot journals 41 and a trough-shaped bearing depression 42 are provided for seating the prismatic pressure member 35, of approximately triangular cross-section.

Figure 15:
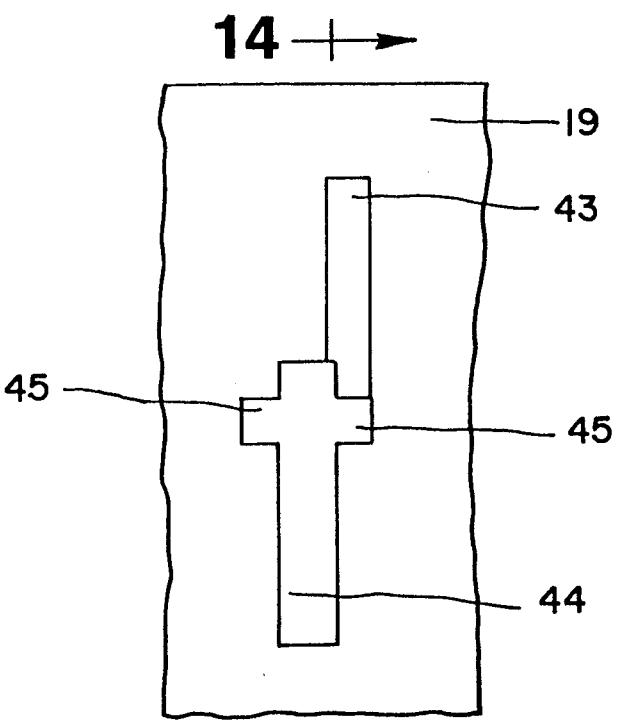
Figure 14:
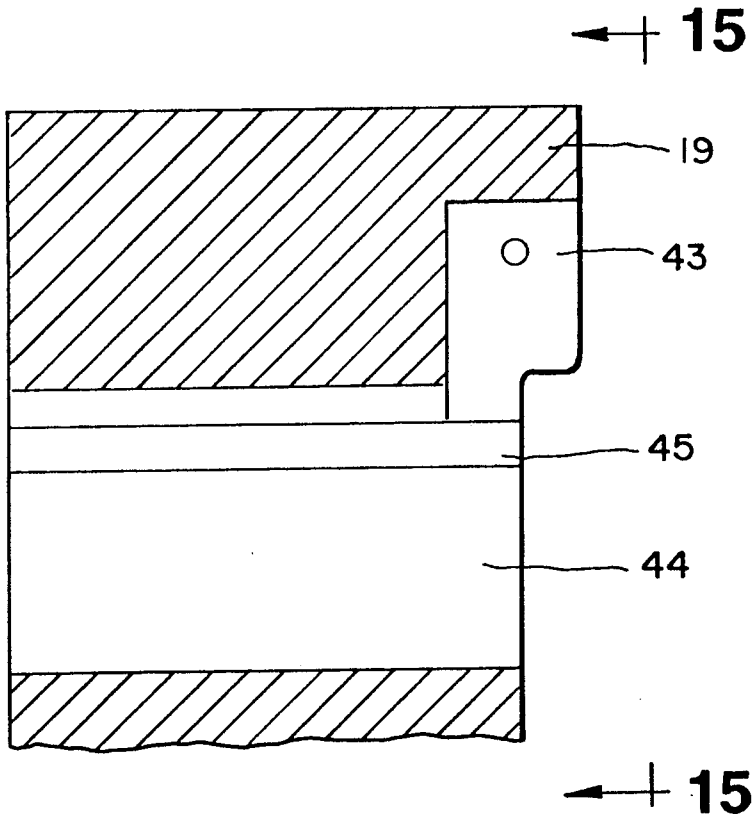
Figure 16:
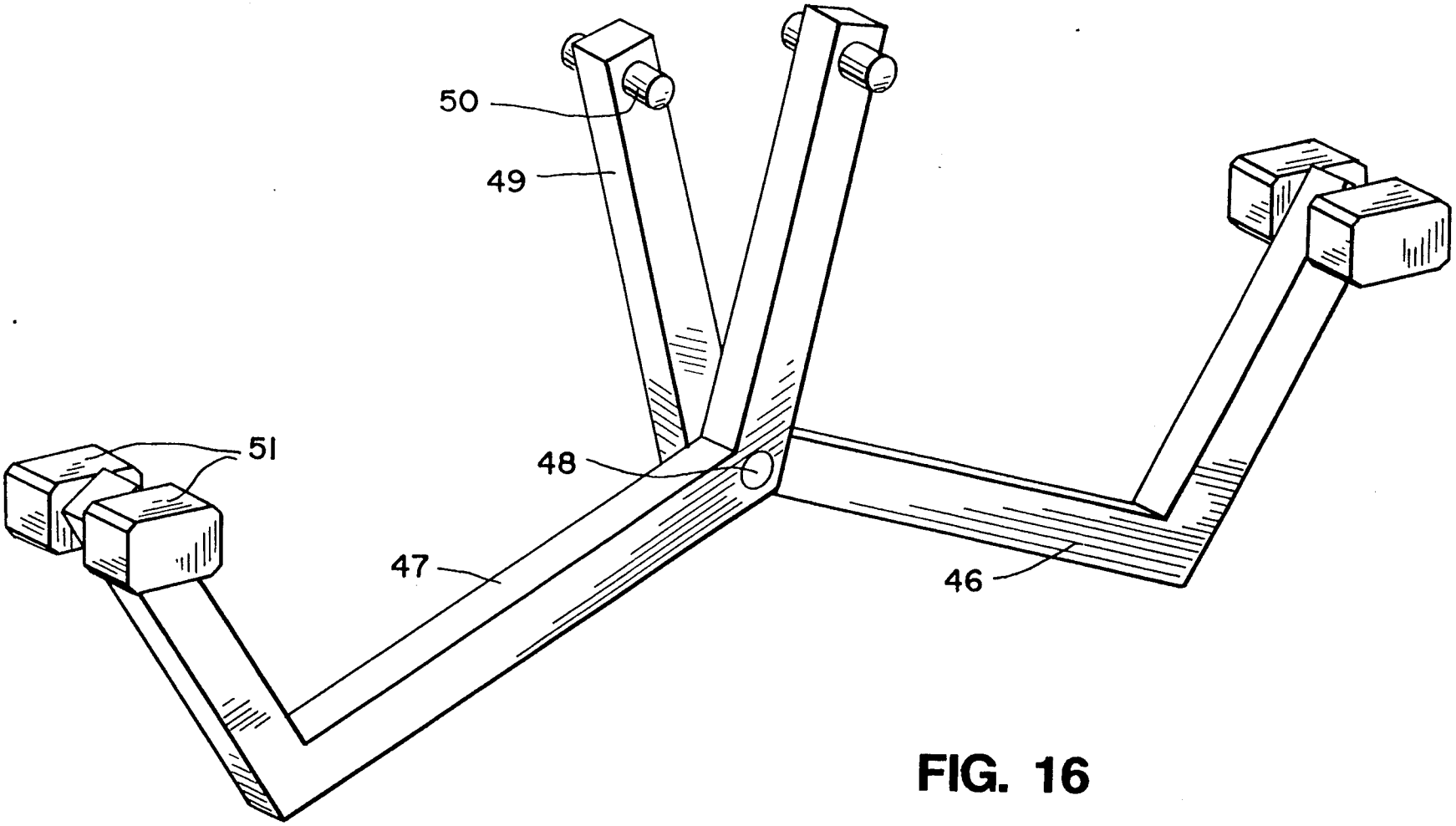
Figure 18:
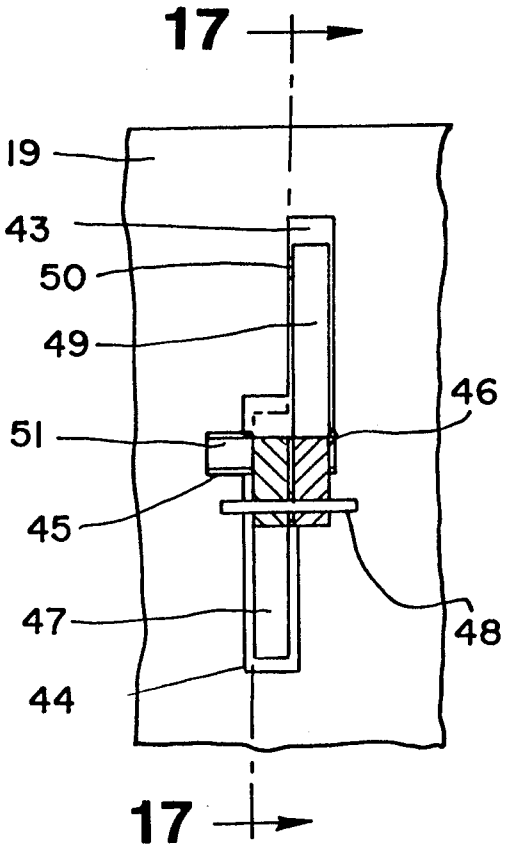
Figure 17:
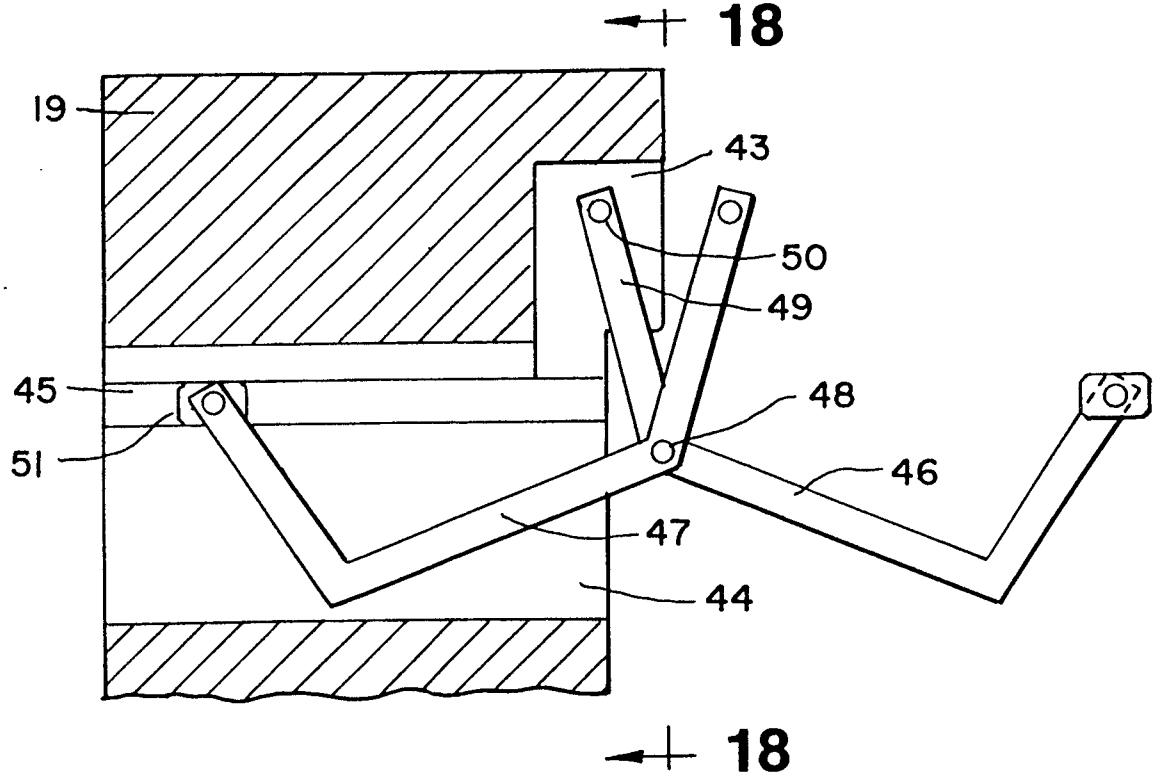

With reference to FIGS. 14 to 21, an example is now described in greater detail of an arrangement for the mounting, reciprocal articulated connection and movement guidance of the lower bending punches 19, 20. In FIGS. 14 and 17, the upper part of the left, lower bending punch 19 according to the illustration in FIG. 6, but without pressure member 35 (FIG. 6), is illustrated in a cross-sectional view. FIGS. 15 and 18 show this upper part of the left, lower bending punch 19 in a partial view as seen from the inside, in order to illustrate the shape or profile of the bearing and guide recesses for angle levers, yet to be described. For a general explanation of this form of embodiment, it should also be mentioned that FIGS. 14 and 15 show simply the upper part of the lower bending punch 19, whereas in FIGS. 17 and 18 the upper part of this lower bending punch 19 together with a pair of angle levers is shown. This pair of angle levers is illustrated, itself alone, in a schematic axonometric view in FIG. 16.

As can be seen from FIGS. 14, 15, 17 and 18, in each lower bending punch, e.g. in the bending punch 19, there are distributed at several positions along the width of the bending device 1, i.e. in the working region itself, a bearing recess 43 in the form of a blind hole and a continuous, slit-shaped opening 44 having rectilinear slide grooves 45, resulting in a cruciform shape of this opening 44 with the slide grooves 45 as seen in elevation (see FIG. 15). For the articulated connection of the two lower punches 19, 20 (see FIGS. 19 to 21), corresponding pairs of doubly cranked angle levers 46, 47, shown also in FIG. 16, are used, these angle levers 46, 47 being connected together pivotally in an angle zone at 48. Reference 48 denotes in FIG. 16 a pin for the pivotal connection of the two angle levers 46, 47, but in this case also there may be a continuous pivot axle, which extends along the entire width of the bending device according to FIGS. 1 to 5 and which is associated with all the angle lever pairs.

Each lower bending punch, e.g. the bending punch 19, is connected in articulated manner to one of the angle levers 46, 47 of such a pair of mutually articulated angle levers, in the region of its bearing recess 43, in which one end of one arm 49 of the one angle lever, e.g. of the angle lever 46 (FIGS. 14, 17 and 18) is hinged by a pivot pin 50 (or again by a continuous pivot axle). Furthermore, this lower bending punch, e.g. 19, receives the opposite end of the other angle lever, that is to say in this case of the angle lever 47, slidably in the slide grooves 45 of the continuous opening or passage 44. For this purpose, a pair of slide blocks 51 can be pivotally mounted at the end of the angle lever 47, and these slide blocks 51 are guided linearly displaceable in the slide grooves 45, see also FIG. 16 and especially the illustration in FIGS. 17 and 18. It should be pointed out that in FIG. 18 the second slide block 51 is concealed by the other angle lever 46 and therefore cannot be seen.

The arrangement in respect of the other lower bending punch 20 is, of course, completely analogous, i.e. the angle lever 47 is articulated to the other bending punch 20, and in contrast the angle lever 46 is slidably guided, see the illustrations in FIGS. 19 to 21.

From these FIGS. 19 to 21, the movement sequence during pivoting of the lower bending punches 19, 20 can now be seen, when these bending punches 19, 20 are being pivoted, for example by means of the rack-and-pinion drive 24 explained by reference to FIGS. 6 to 9 and not illustrated in FIGS. 14 to 21, as pivoting drive or pivoting mechanism. The double lever assembly or assemblies comprising the angle lever pairs 46, 47 thereby assure an exactly opposed, synchronous pivotal movement of the two bending punches 19, 20, while determining the exact position of the imaginary pivot axis 21, see FIGS. 20 and 21. In detail, FIG. 19 shows the starting or at-rest position, in which the lower bending punches 19, 20 are arranged with their upper faces horizontal. In the position according to FIG. 20, the lower bending punches 19, 20 have already been pivoted through a portion of their pivoting stroke, and according to the view in FIG. 21 they have finally reached, for example, their limiting pivoted position. From FIGS. 19 to 21 it can be seen that the hinge axis 48 of the angle lever pairs 46, 47 moves slightly vertically basically along the central plane (plane 23 in FIG. 6). The slide blocks 51, during this pivotal movement, slide in their slide or control grooves 45, but in contrast the angle levers 46, 47 are pivoted at their opposite ends relative to the associated bending punches 19, 20.

With regard to the pivotal mounting of the angle levers 46, 47 in the bending punches 19, 20 (articulation axis 50), it is also conceivable to insert bearing blocks (not shown) into the bearing recesses 43 from the inner face or from the end (which can be seen in FIG. 15), the ends of the angle levers 46, 47 being pivotally journalled in these bearing blocks. These bearing blocks, not further illustrated in the drawing, can correspond in their dimensions exactly to the bearing recesses 43, and they can moreover be secured in these bearing recesses 43 by means of screws or bolts.

Figure 22:
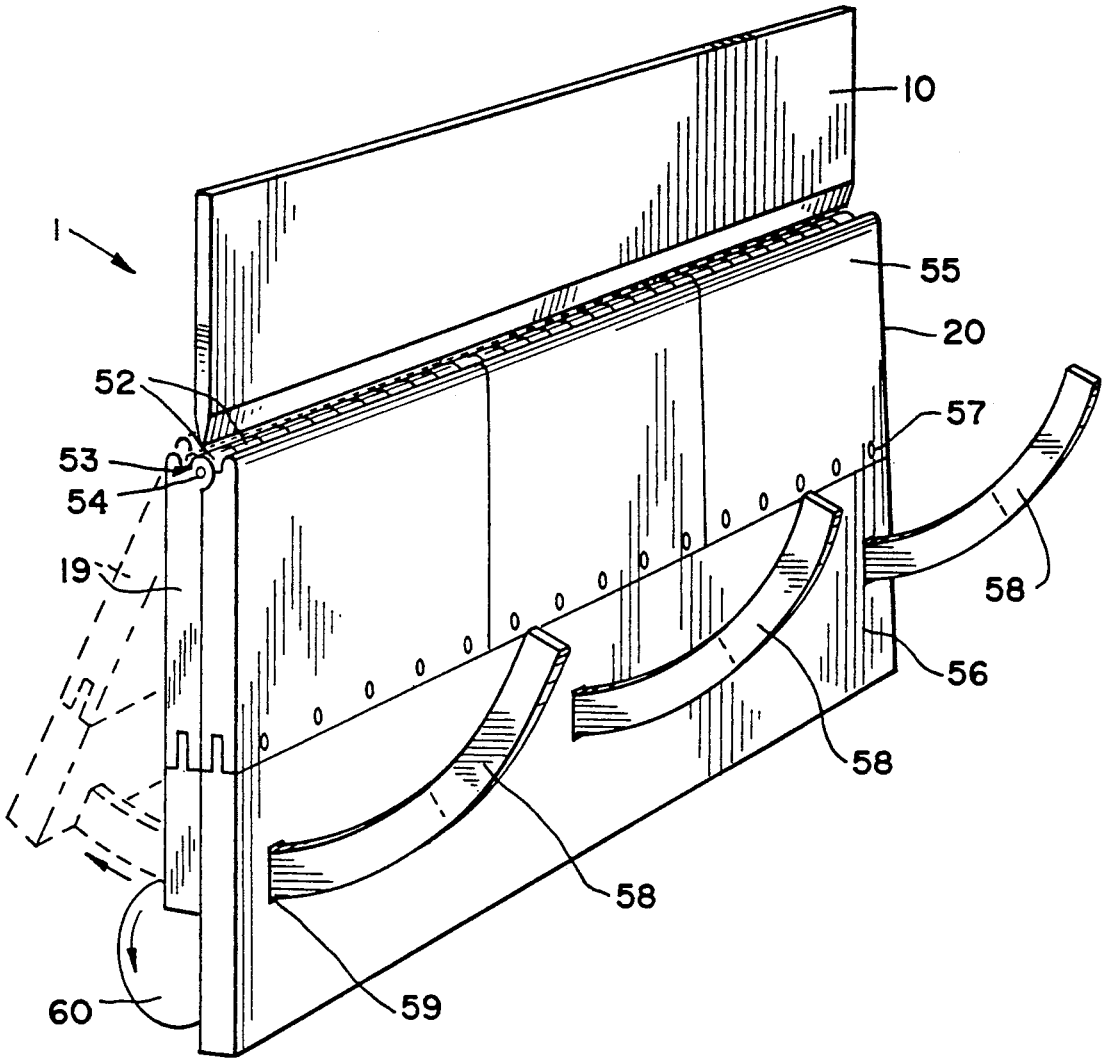
Figure 23:
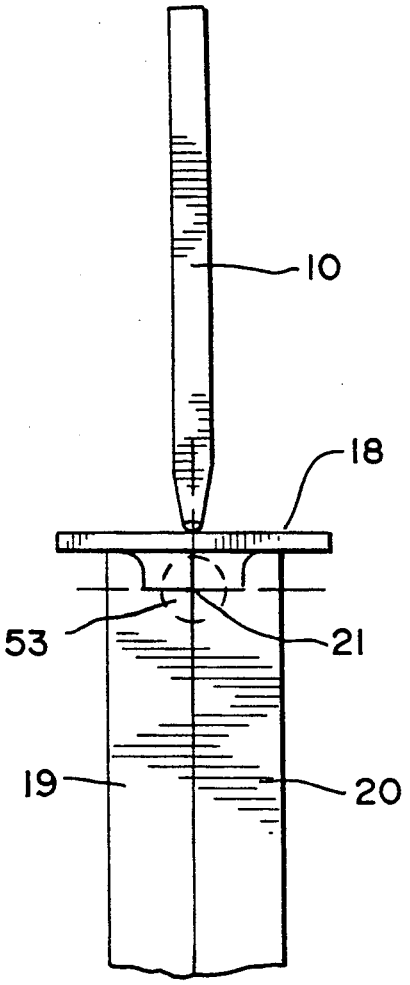
Figure 24:
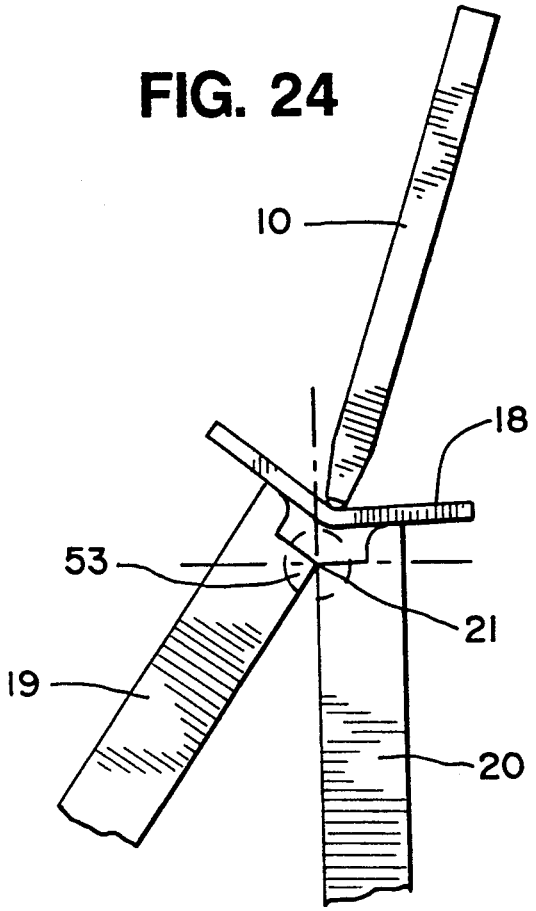
Figure 25:
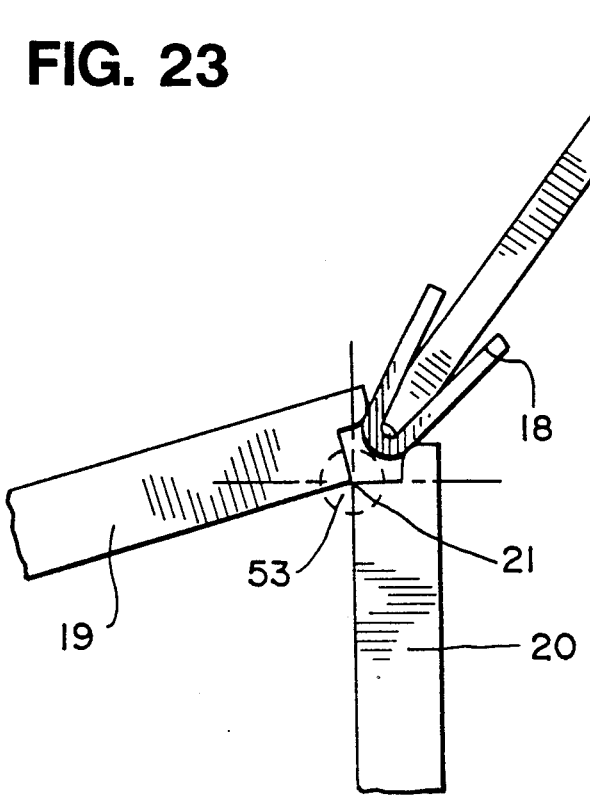

In FIGS. 22 to 25, a further sheetbending device 1 is illustrated highly schematically with its basic working components, this sheet bending device corresponding in respect of the relative movement of its punches or tools 10, 19 and 20, entirely to the examples of embodiment so far described, but during the bending process it is not the upper punch 10 that is held stationary, but the one lower punch 20, at the right in the view of FIGS. 22 to 25, whereas the other lower punch 19 is pivoted during bending of the sheet 18 (see FIGS. 23 to 25) in correspondence with the previous examples of embodiment, and to create the relative pivotal movements between the punches, the upper punch 10 is pivoted—at half the angular velocity of the left, lower punch 19—see also the intermediate position of the three punches shown in FIG. 24 and the final position shown in FIG. 25. If, in this form of embodiment according to FIGS. 22 to 25, the movement sequence were to be observed from the upper punch 10 (at-rest position), then a completely identical pivot movement sequence to that already explained with reference to FIGS. 1 to 11 would result. The individual movement phases are, however, shown in FIGS. 22 to 25 as observed from the stationary frame (which is not further illustrated in FIGS. 22 to 25). A kinematic system of the type shown in the bending device of FIGS. 22 to 25 may be desired if only a slight movement, if any, is to be performed on the sheet 18 on the one side of the bending edge.

In detail, in the example according to FIGS. 22 to 25, the two lower punches 19, 20 are connected together, for mutual pivotal support, in the manner of a hinge with intermeshing eye members 52 to form a hinge joint 53, a hinge pin or axle 54 extending through the entire hinge assembly. Laterally of the hinge 53, the two lower punches 19, 20 have a rounded cheek form where they come into contact with the sheet 18 to be bent. The two lower tools or punches 19 may also, in the interest of easy replaceability, by constructed from individual tool segments 55 which are firmly connected to a toolholder or punch lower part 56, for example by means of bolts 57. As pivoting drive for the left, lower punch 19, circular arc-shaped guide rails 58 having a circular arc-shaped toothed rack, not further illustrated in detail, may be provided, which pass through guide slits 59 in the base part 56 of the other lower punch 20 and mesh with drive pinions 60, which in principle correspond to the pinions 29, 30 respectively according to FIGS. 6 to 9. The drive for these pinions 60 may be provided in the manner already mentioned in relation to FIGS. 6 to 9 by a drive motor, not shown in FIG. 22, and a gear. Another possible form of embodiment for this purpose and also a hinge connection and tool segment assembly in detail are shown in FIGS. 27 to 35, to be described below.

In FIG. 22 it is also shown schematically in broken lines how, as the pinion 60 is rotated counter-clockwise (see arrow), the left bending punch 19 is pivoted outwards, i.e. away from the right punch 20. For simplicity, however, it has not been shown that, simultaneously with this pivotal movement of the one lower punch 19, the upper punch 10 pivots also, and as already mentioned at half the angular velocity of the lower punch 19.

The drive of the upper punch 10 may be provided in principle in analogous manner to that for the lower punch 19, the necessary reduction ratio of 2:1 being assured by a gear. Such a drive assembly is itself conventional, and therefore does not need to be explained further at this point.

It may also be mentioned that the mounting of the upper punch 10 in the frame, not further illustrated here, can be provided in the bending device according to FIG. 22 in principle in a similar manner to that already described in relation to FIGS. 1 to 5, i.e. in particular with supports 6, 7 and an upper mounting support 8, pivotally journalled thereon.

In FIGS. 23 to 25, the pivot axis 21 for the relative pivoting between the lower bending punches 19, 20 is illustrated, which in the present case coincides with the geometric axis of the hinge pin 54 (FIG. 22) of the hinge 53. During bending, the upper punch 10 also is pivoted about this pivot axis 21, see the illustration in FIG. 24 and FIG. 25.

The centre of the circular arc-shaped rails 58 also of course lies on this pivot axis 21 (i.e. the geometric axis of the hinge pin 54).

In the example of embodiment according to FIG. 26, once again the two lower bending punches 19, 20 are pivoted symmetrically relative to the upper counter-punch 10, which in the present case is indicated only by the curve of the circle representing the bending edge, and for this purpose once again there are provided at several points along the width of the device 1 circular arc-shaped guide tracks on the frame 2 (the tracks not shown further in FIG. 26, but see also FIGS. 28 and 29, bearing groove 78) with correspondingly arc-shaped toothed racks or segments movable therein, referenced 61 (for bending punch 19) and 62 (for bending punch 20). These circular arc-shaped toothed rails 61, 62 each mesh with a pinion 63 (for toothed rail 61) and 64 (for toothed rail 62). The pinion 63 is driven from a common drive pinion 65, which may be coupled with a motor (corresponding to the motor 15 in FIG. 6), and the pinions 63, 64 mesh directly with each other to revolve in opposite directions, similarly to the pinions 29, 30 according to FIG. 6.

Shoes 66, 67 respectively are firmly fixed to the toothed rails 61, 62 respectively, these shoes 66, 67 being guided as slding shoes in the slide guide tracks, not shown here, which are associated with the toothed rails 61, 62. The toolholders 68, 69 for the lower tools or bending punches 19, 20 are connected to these shoes 66, 67 by hinges 70, 71 respectively, to permit slight adjustment movements of the lower tools or punches 19, 20 relative to the surface of the metal sheet during bending.

The upper counter-punch 10 is (also) driven vertically downwards during bending of the sheet 18 for example by means of a drive similar to the spindle drive 14 of FIG. 1, this vertical downward driving being coupled to the pivotal movement of the lower bending punches 19, 20—for example by a numerical control via a computer (not shown)—in order to ensure, depending upon the metal sheet thickness, that in the bending of the sheet 18 when the two lower bending punches 19, 20 pivot apart and at the same time the upper counter-punch 10 moves downwards (compare the intermediate position during bending shown in broken line in FIG. 26), that a friction grip is achieved of the lower bending punches 19, 20 on the metal sheet 18, so that no relative movement between these punches and the sheet 18 takes place along its surface. In this way an especially careful handling of the metal sheet 18 during bending is assured and surface defects that otherwise frequently occur are avoided.

Figure 27:
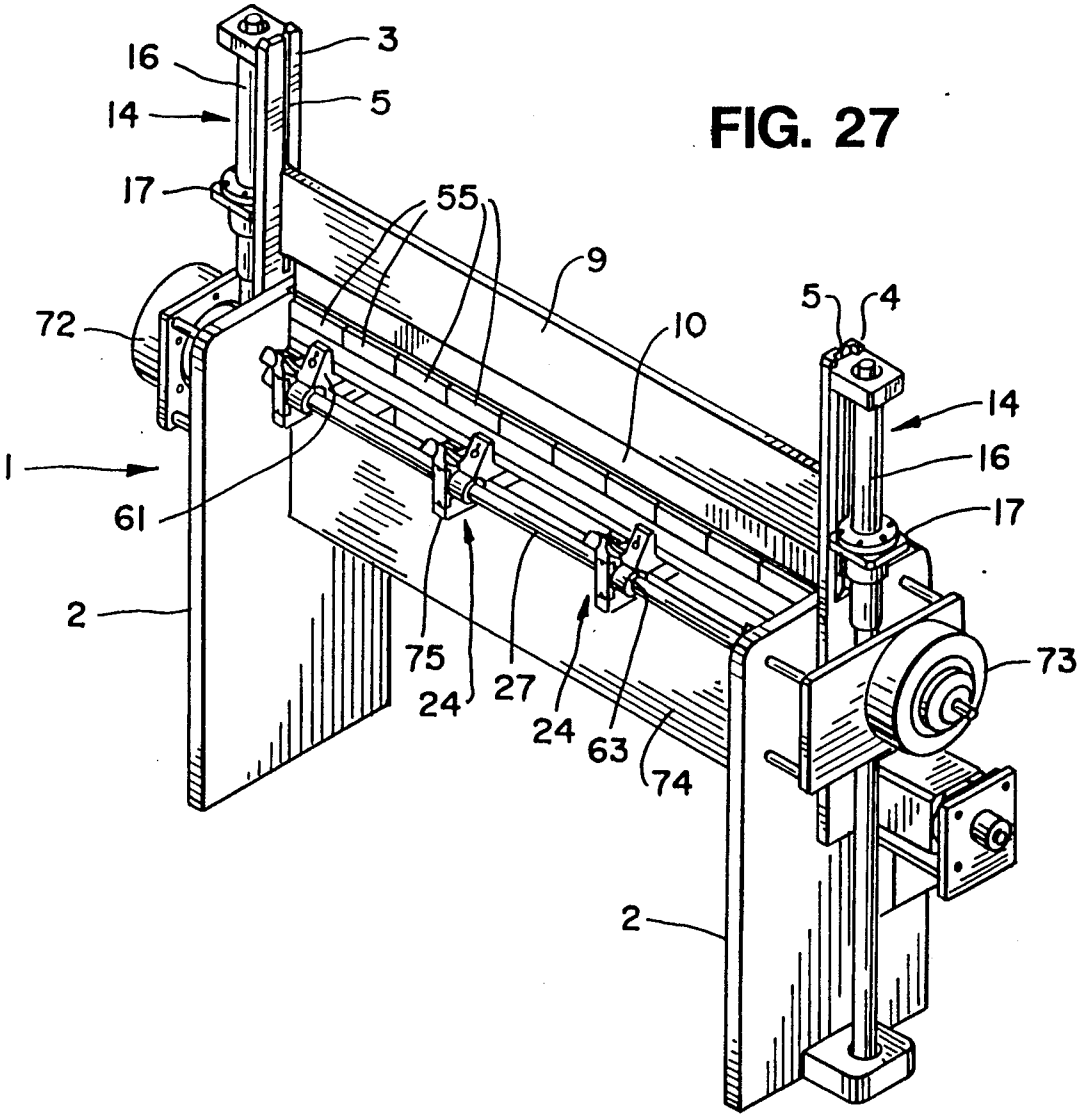

The metal sheet bending device, bending machine or bending press 1 illustrated in FIG. 27 also possesses a lower frame 2, on which vertical guides 5 are provided in main end supports 3, 4, in which guides an upper toolholder 9 comprising a web-shaped or sword-shaped counter-punch 10 (also termed upper tool or simply sword) is guided displaceable vertically up and down. This counter-punch 10 is preferably mounted replaceably on the toolholder 9, but could also be constructed in one piece with it; here again, preferably, a more or less knife-shaped lower bending edge 13 (see FIG. 29) is provided, but other cross-sectional shapes could also be used, depending upon the form of bend to be produced.

For the upward and downward movement of the upper counter-punch 10, spindle drives 14, for example, are again used as in FIG. 1, which contain a spindle 16, driven from an electric drive motor, possibly via a gear and a clutch (not shown), the spindle 16 cooperating with a spindle nut 17 attached to the toolholder 9 in order to move the toolholder 9 together with counter-punch 10 up and down in the guides 5 as the spindle 16 revolves.

For bending a sheet 18 (see FIGS. 31 to 33), two lower plate-shaped or cheek-shaped bending punches 19, 20 are also provided on the frame 2. These two lower bending punches 19, 20 are pivotally journalled to the frame 2 in a manner to be explained later, being pivotal about a common pivot axis 21 (see FIGS. 31 to 33), which lies in the region of the bent edge 22 to be produced in the metal sheet 18 to be bent, but somewhat below it, and which in particular lies also in the plane 23 (FIGS. 29 and 31), defined by the guides 5, 6, for the upward and downward movement of the counter-punch 10.

Figure 28:
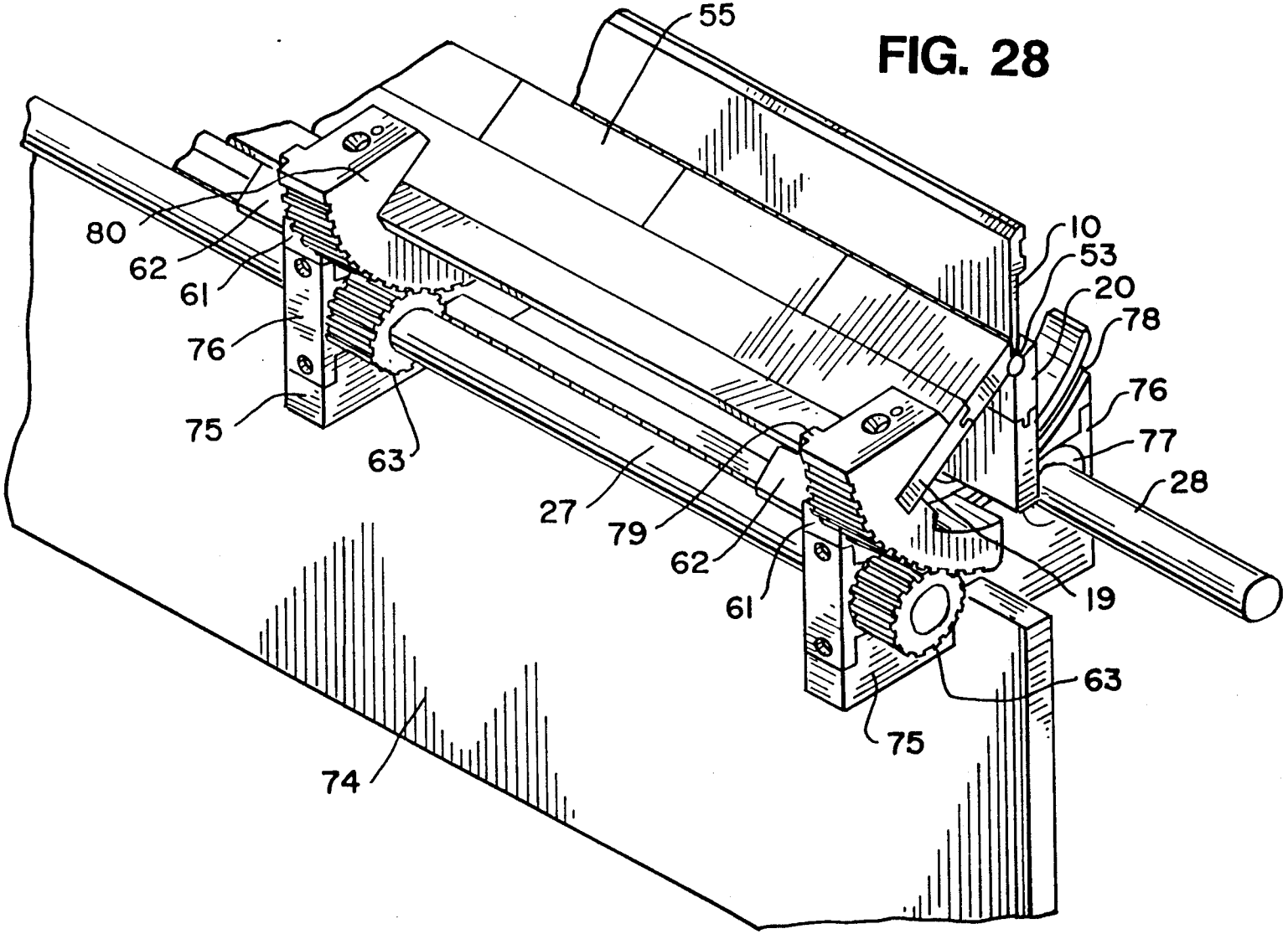
Figure 29:
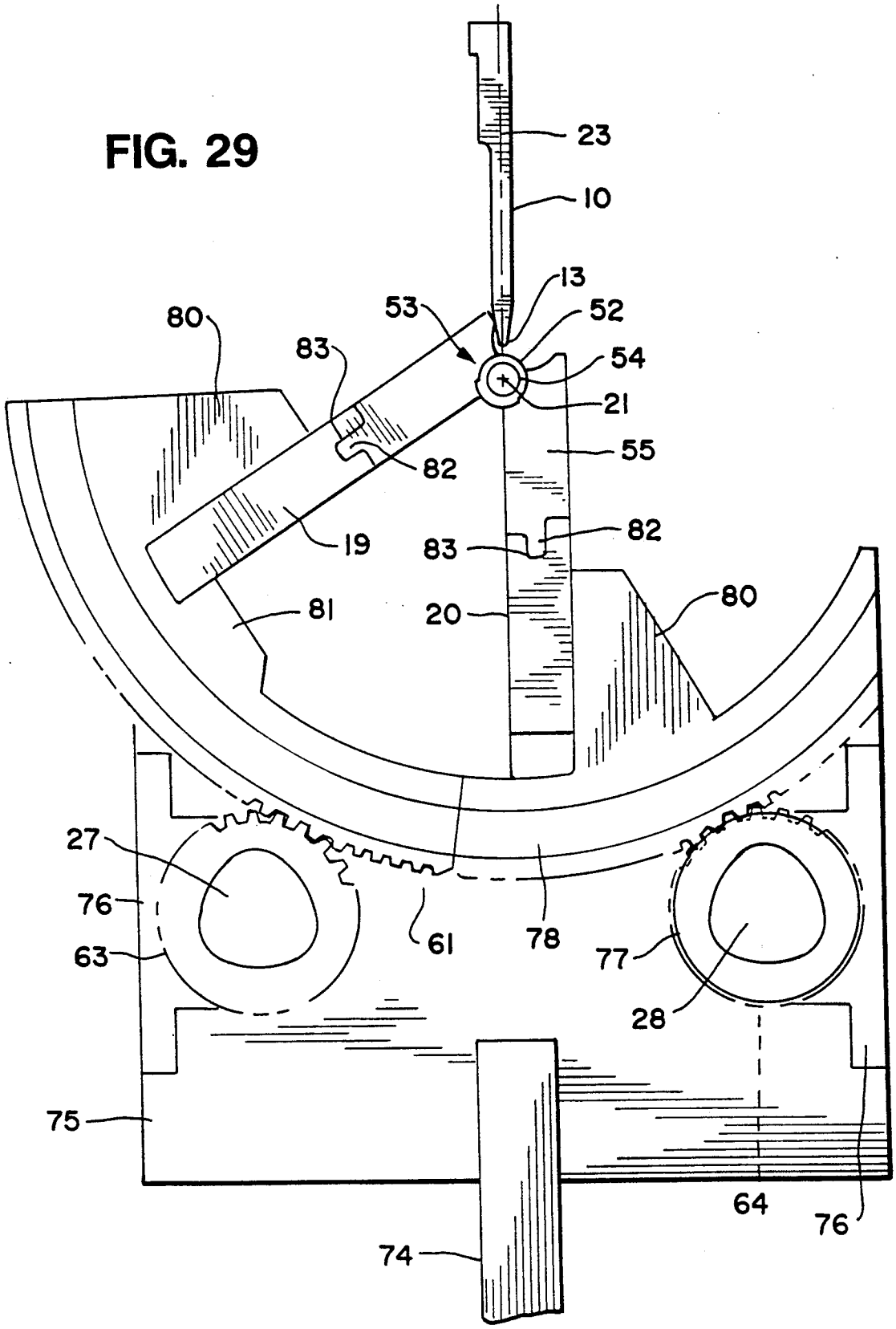

As a drive for pivoting the lower bending punches 19, 20 about the common pivot axis 21, a pivoting mechanism is used which, in the present example, contains a plurality of pivot drives indicated schematically in FIGS. 27 to 29 at 24, in the form of rack-and-pinion drives, distributed across the width of the bending device 1. In each case a circular arc-shaped toothed rack or rail 61, 62 is firmly fixed to the lower region of the relevant lower bending punch 19, 20 respectively, as can be seen not only from FIGS. 27 to 29 but also from FIGS. 34 and 35. These toothed racks or segments 61, 62 mesh with gear wheels or pinions 63, 64 respectively, for example of equal sizes, seated on shafts 27, 28 respectively parallel to one another and to the bending punches 19, 20. The two shafts 27, 28 are driven each from, for example, an electric drive motor 72, 73—possibly via a gear not further illustrated—as can be seen from FIG. 27. The two shafts 27, 28 extend over the entire width of the bending device 1 and they are rotatably journalled to the frame 2 at the ends and also at intermediate positions, in the region of the individual rack-and-pinion drives 24, in corresponding bearing components 75, to be explained later. For each toothed rack drive 24 there is a toothed rack 61, 62 respectively and also a pinion 63, 64 respectively, keyed onto the corresponding shaft 27, 28 respectively, and as already mentioned above there are several such rack-and-pinion drives 24 provided as pivoting drive and distributed across the width of the bending device 1, so as to apply a distributed drive torque. When the shafts 27, 28 are driven in rotation, therefore, the toothed racks 61, 62 are moved along a circular arc-shaped track, the centre of which lies on the pivot axis 21, these racks pivoting apart the lower bending punches 19, 20, connected to them, in an outward splaying movement, see in particular the illustrations in FIG. 31 (at-rest position) and FIGS. 32 and 33 (pivoted-apart working position).

For the already mentioned mounting, on the one hand of the shafts 27, 28, and on the other hand of the bending punches 19, 20, on the frame 2, several bearing components 75, extending transversely to a main beam 74, are firmly fixed to this main beam 74 of the frame 2, at intervals distributed across the width of the machine at points corresponding to the rack-and-pinion drives 24. These bearing components 75 contain, on the one hand, bearings 77 which can be replaced by removable bearing covers 76 (see also FIGS. 28 and 29) for the shafts 27, 28, and, on the other hand, they are provided in their upper region on both sides with circular arc-shaped slide grooves 78 (see FIG. 28, right), in which the circular arc-shaped toothed racks or toothed segments 61, 62 are slidably guided by means of correspondingly curved guide blocks or strips 79, provided on them. Thus, at each such bearing component 75, two toothed segments 61, 62 are slidably guided, the one for the shaft 27 and the other for the shaft 28. By means of this bearing arrangement, comprising the comparatively solidly constructed toothed racks 61, 62, their guide blocks 79, the circular arc-shaped slide grooves 78 and the bearing components 75, a load distribution across the width of the machine is thereby achieved, so that the forces that occur and which must be accepted during bending are introduced into the frame 2 and its transverse main beam 74, in distributed manner. In this way the relatively not very massive construction of the bearing components 75 is sufficient.

It should be mentioned that in the illustration in FIG. 29, only the pinion 63 associated with the shaft 27 can be seen, which is situated according to the illustration also in FIGS. 27 and 28 in front of the bearing component 75, and accordingly in FIG. 29 the pinion 64, associated with the shaft 28, which is situated behind this bearing component 75, is indicated only in broken line. On the other hand, from this view in FIG. 29, at the shaft 28 indicated at the right therein, the bearing 77 for this shaft 28, accessible via the bearing cover 76, can be seen, compare also the view in FIG. 28. It can also be seen from FIG. 29 that the two shafts 27, 28 are constructed with a cross-section of a so-called "lobed cylinder", so that the pinions 63, 64 respectively can be non-rotatably keyed onto the shaft without weakening the cross-section, such as in the case of a wedge and keyway connection. The relevant bending punch 19, 20 respectively can be seated on the associated toothed segment 61, 62 respectively, for example in a simple push-in fit or press-fit between seating projections 80, 81, integral with the toothed segment 61, 62, see also FIG. 29 and FIGS. 34 and 35, but a screwed connection could also be used.

From the view in FIGS. 28 and 29, it can be seen that the two bending punches 19, 20 are connected to each other in articulated manner over the entire working width along their upper, inner edges by a hinged connection 53. According to FIG. 30, intermeshing hinge eyes 52 are provided, through which a hinge pin 54 extends in the assembled condition. This hinge connection 53, with the hinge pin 54, defines the aforementioned pivot axis 21, about which the two bending punches 19, 20 are pivoted in operation.

Figure 34:
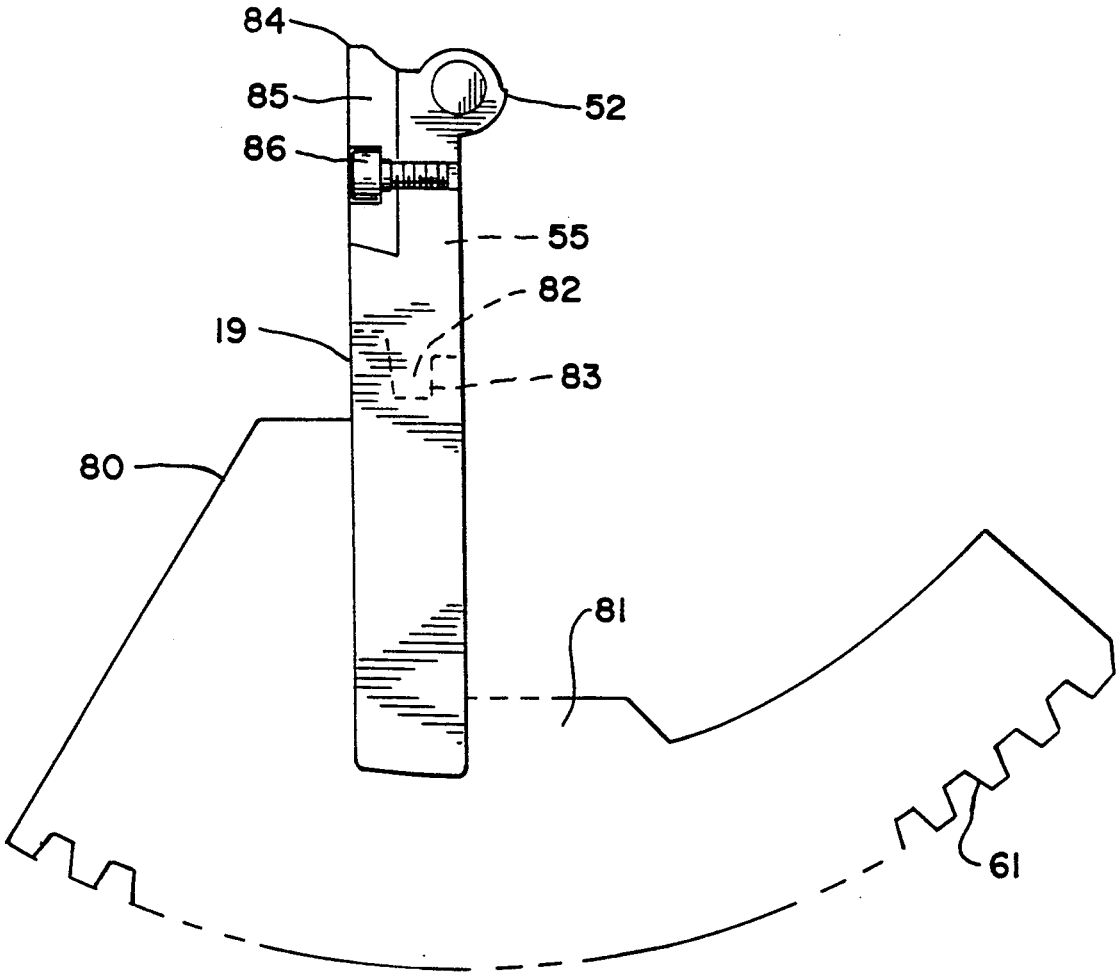
Figure 35:
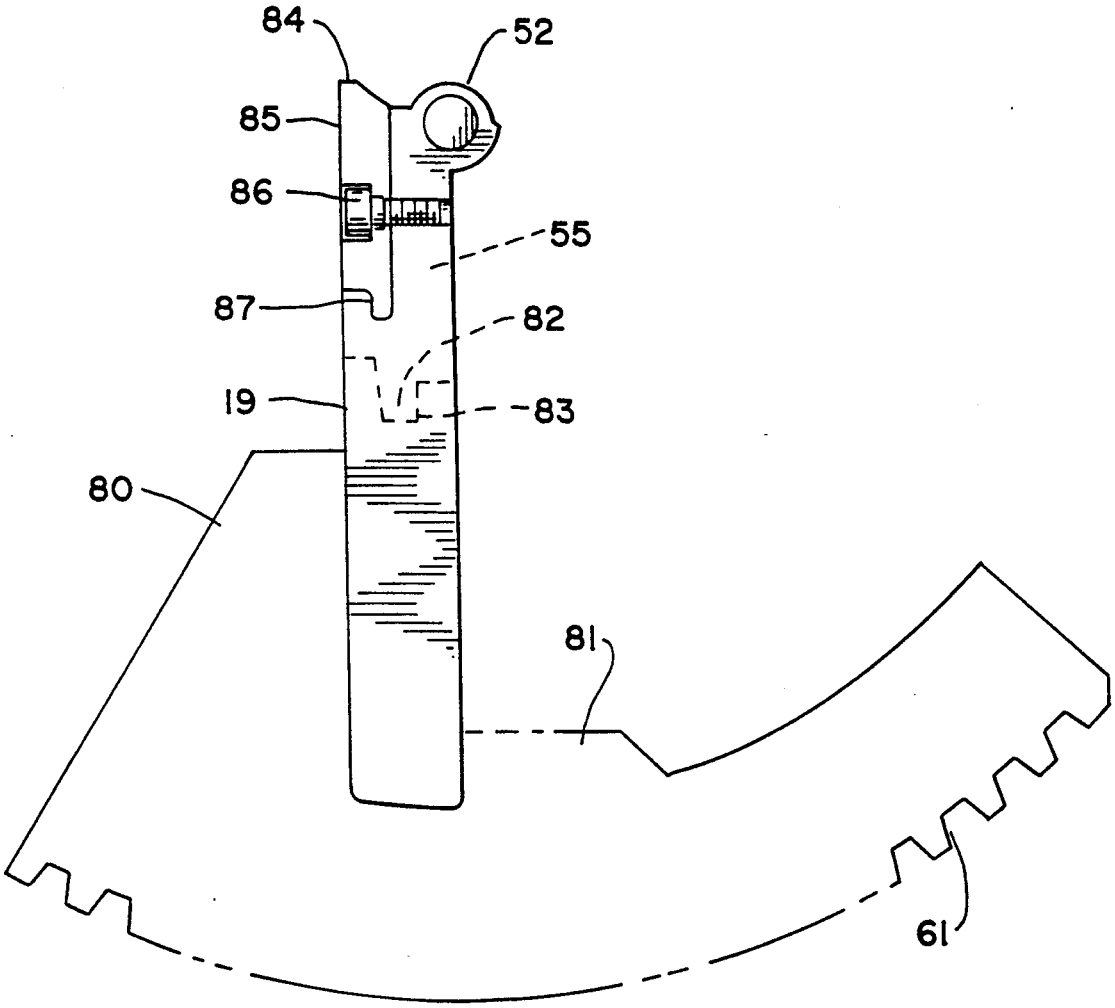

In detail, the bending punches 19, 20 are constructed as toolholders with separately removable, replaceable tool segments 55, the tool segments 55 being connected together in articulated manner in pairs by the hinge pins 54, adapted to appropriate length. These tool segments 55 are firmly held in the bending punches 19, 20 respectively, functioning as toolholders, by a simple push-in connection, comprising a longitudinal tongue 82 and a corresponding groove 83, so that replacement of the tool segments 55 can be performed especially simply and quickly. It has been found that a fixed connection between the individual tool segments 55 and the relevant toolholder or bending punch 19, 20 is surprisingly not necessary, this being associated also with the fact that, in operation, of those forces that occur during bending, the horizontal components are at least compensated basically via the hinge 53, so that only vertical forces or forces acting in the plane of the bending punches 19, 20 are transmitted by the push-in connection (tongue 82, groove 83), which can readily be achieved by this tongue-and-groove connection 82, 83. Having regard to the wear that occurs in operation, it may however be advantageous to provide tool inserts 85, which apply the actual bending work to the metal sheet via contact zones 84 (see not only FIGS. 29 and 30 but also FIG. 34), these inserts 85 being, for example, hard metal inserts, which are screwed by bolts 86 to the tool segments 55—or to the bending punches 19, 20—see FIG. 34. A modified form of insert, comprising an additional tongue-and-groove connection 87 for the hard metal insert 85, is illustrated in FIG. 35. It is also shown in FIGS. 34 and 35 by broken lines that, in the case of the bending punches, e.g. the left bending punch 19, the tool segments 55 according to FIGS. 27 to 34 may also be omitted, i.e. the bending punches 19 (and 20) then themselves form the hinged connection 53; the inserts 85 can be continuous or may be segmented corresponding to the tool segments 55 shown in FIGS. 27 to 30.

The method of functioning of the last described sheet bending device 1 will now be explained with reference to the schematic illustration of FIGS. 31 to 33 and also with reference to FIGS. 28 and 29 (in which the left bending punch 19 is shown pivoted).

Figure 31:
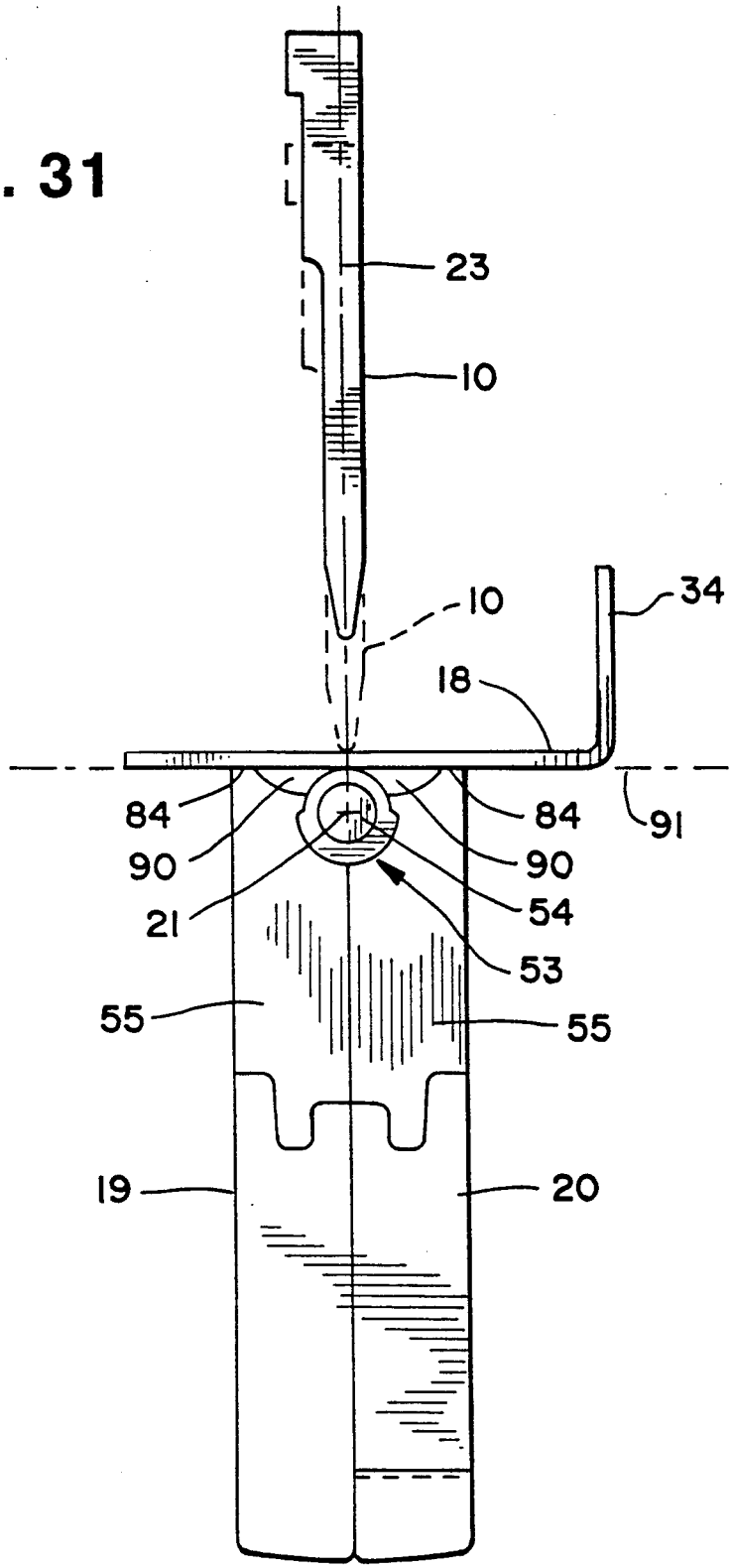

The starting or at-rest position of the sheet bending device 1 is shown in full lines in FIG. 31. The upper counter-punch 10 here adopts its upper at-rest position, raised off the sheet 18, and in this position a metal sheet 18 to be bent can be fed by hand or mechanically to the sheet bending device 1 and brought on it into position. If a sheet bending cycle is now commenced, the counter-punch 10 is first moved downwards by means of the spindle drives 14 (FIG. 27), until it touches with its edge 13 the metal sheet 18 to be bent, which has previously been brought onto the lower bending punches 19, 20. This phase, in which the metal sheet 18 is virtually clamped between the three punches or tools 10, 19 and 20, is also illustrated in FIG. 31, with the counter-punch 10 shown in broken line.

The drive to the drive shafts 27, 28 of the rack-and-pinion drives 24 for the lower bending punches 19, 20 is now switched on. Accordingly, the toothed racks 61, 62 are driven along the slide grooves 78 (FIG. 29), thus pivoting the bending punches 19, 20 about their common pivot axis 21 in opposite directions, i.e. according to the illustrations in FIGS. 31 and 32, the left bending punch 19 clockwise and the right bending punch 20 counter-clockwise. By means of the pivoting, lower tools 19, 20, the sheet 18, bearing against the lower edge 13 of the upper counter-punch 10, is, for example, initially symmetrically bent, a bent edge 22 being produced, see FIG. 32. During this bending operation, the counter-punch 10 is with advantage held fixed or stopped in its position, for instance by means of the spindle drives 14 (FIG. 27), so that it forms a stationary counter-holder during this bending operation. The sheet 18 is bent through approximately 90°, for instance, along the bending edge 22, see the illustration in FIG. 32; as illustrated further in FIG. 33, in this bending operation an acute angle of bend can be created in the sheet 18 without difficulty. If the metal sheet 18 had already been subjected to a bending operation, for example the already bent edge 34 in FIGS. 31 to 33, then a so-called "collision" case can occur, in which this already bent edge 34 during bending strikes against the counter-punch 10. In order to prevent undesired deformations in the sheet 18 during a further driving of the bending punches 19, 20, the upper counter-punch 10 could, for example, as shown in FIGS. 1 to 12, once again be journalled pivotally about a horizontal axis, so that it could deflect when struck by the edge 34. To eliminate the need for the pivot bearing for the counter-punch 10 required for this case, however, a different possible solution may be provided also for this collision case, it being advantageous that a force balancing takes place through the hinge 53; therefore, in addition to the described method of operating, in which the lower bending punches 19, 20 are pivoted symmetrically and in opposite directions, especially at the same angular velocity, asymmetric methods of operation can also be permitted, since in total only a relatively small resultant horizontal component remains. To this extent, in the present sheet bending device, independent pivot drives are preferably associated with the two bending punches 19, 20, in the present example by the separate drive motors 72, 73 and the shafts 27, 28 driven by them. Therefore, in the described collision case, when the sheet edge 34 strikes laterally against the counter-punch 10, as in FIG. 33, the bending punch 20 situated on this side is stopped, and only the other bending punch 19 is pivoted further, in order to continue the bending operation on the sheet 18 to its end, as illustrated in FIG. 33.

Figure 33:
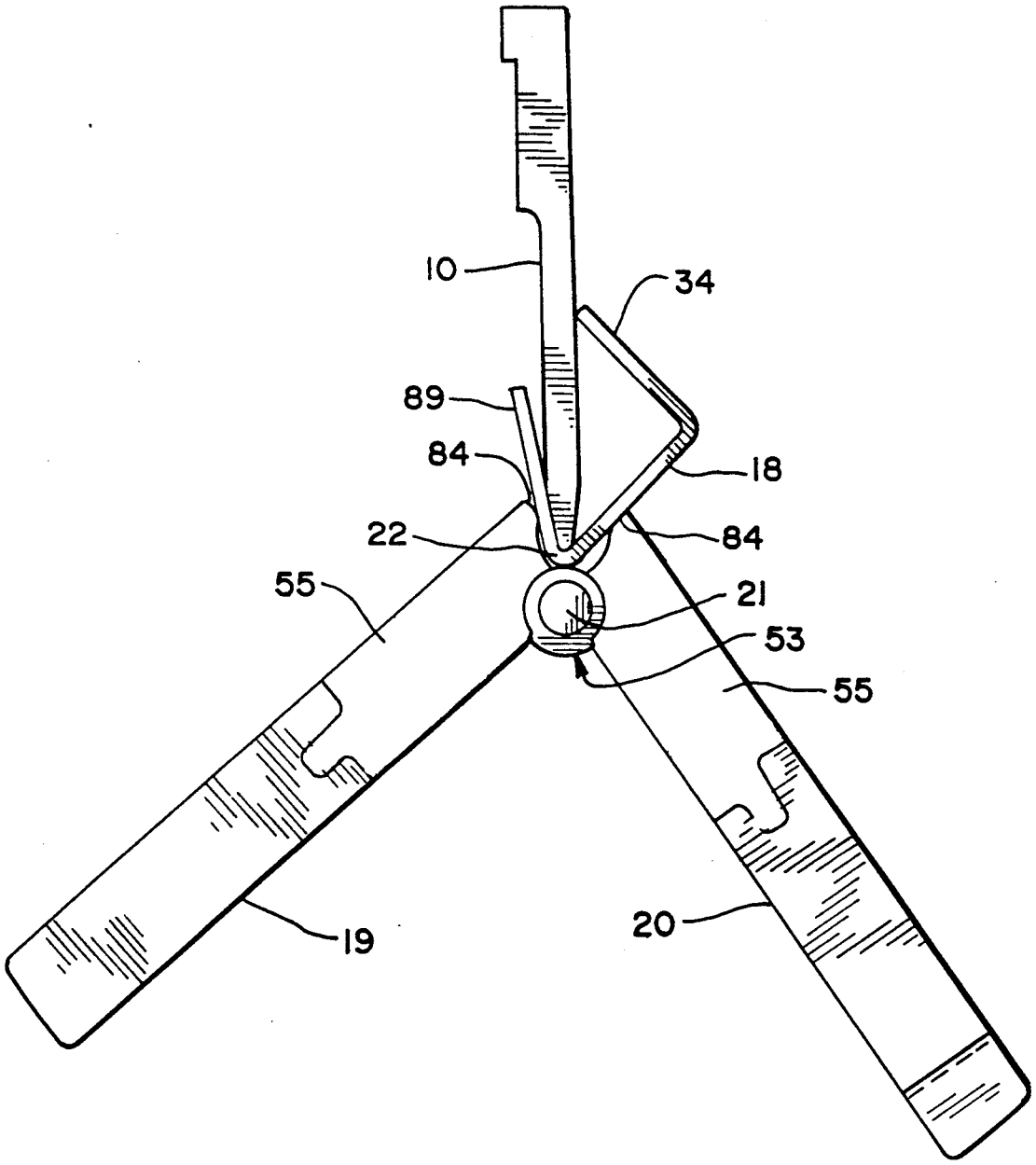

Instead, however, it would also be conceivable to pivot the two bending punches 19, 20 from the start (FIG. 31) at different angular velocities, in order in this way to reach the final position generally as shown in FIG. 33 in one continuous operation.

It would also be possible, after the situation shown in FIG. 33 had been reached, for the counter-punch 10 to be moved upwards out of the sheet profile 18, after which the two bending punches 19, 20 are pivoted further upwards in the sense of an outward splaying, with the result that in the region of the bent edge 22 produced, a fold would be created, i.e. the left sheet edge in FIG. 33 would then be pressed directly against the remaining sheet 18. It has been found that in this bending phase the friction forces applied via the contact zones 84 to the sheet are sufficient for holding the already largely bent sheet 18 between the bending punches 19, 20, without the counter-punch 10 being required for this purpose.

Figure 32:
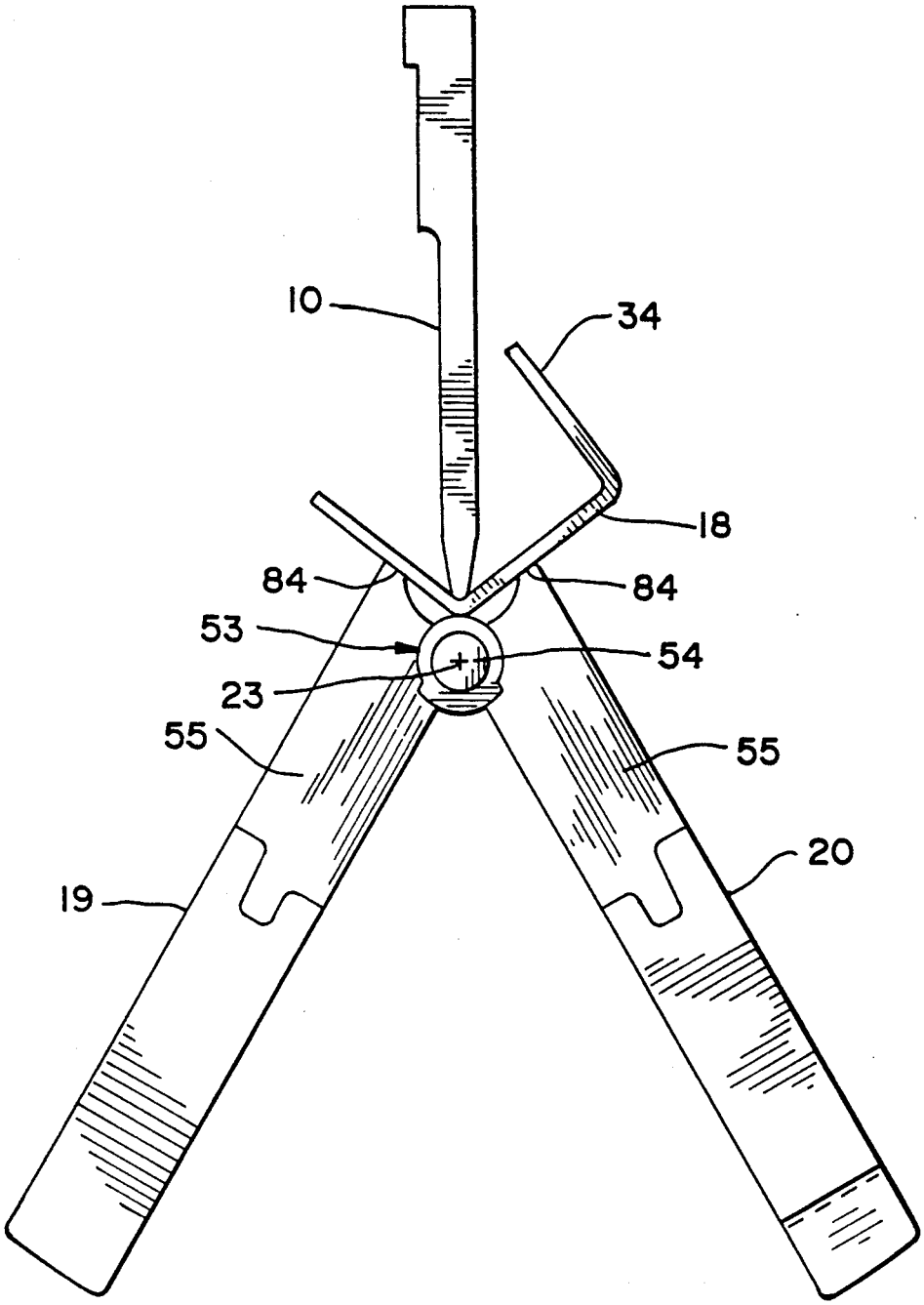

For the commencing bending operation, see FIGS. 31 and 32, with the present sheet bending device 1 it is also of importance that the described sheet contact zones 84, which in the at-rest position of the bending punches 19, 20 (FIG. 31) define the bearing or seating plane for the sheet 18, shall lead via a depression 90 into the hinge joint 53. As bending commences, these depressions 90 create room for the metal sheet 18 in the region of the bent edge 22 to be created, so that the sheet is not crushed there, as could occur if the upper faces of the mutually adjoining bending punches were flat. It can also be seen from FIG. 31 that the hinge axis or pivot axis 21 runs somewhat below the sheet bearing plane 91 defined by the contact zones 84 (that is to say the lower face of the sheet 18 in FIG. 31), with the result that for the commencing bending work a favourable lever arm is created for transferring the bending moment to the sheet 18.

After the bending operation has been completed, the pivot drives for the bending punches 19, 20 are again reversed, in order to bring the lower bending punches 19, 20 back into the vertical starting position according to FIG. 31 and to displace the upper counter-punch 10 upwards (if this has not already been done). The bent sheet 18 can now be brought into the next bending position or be removed out of the bending device 1.

Figure 30:
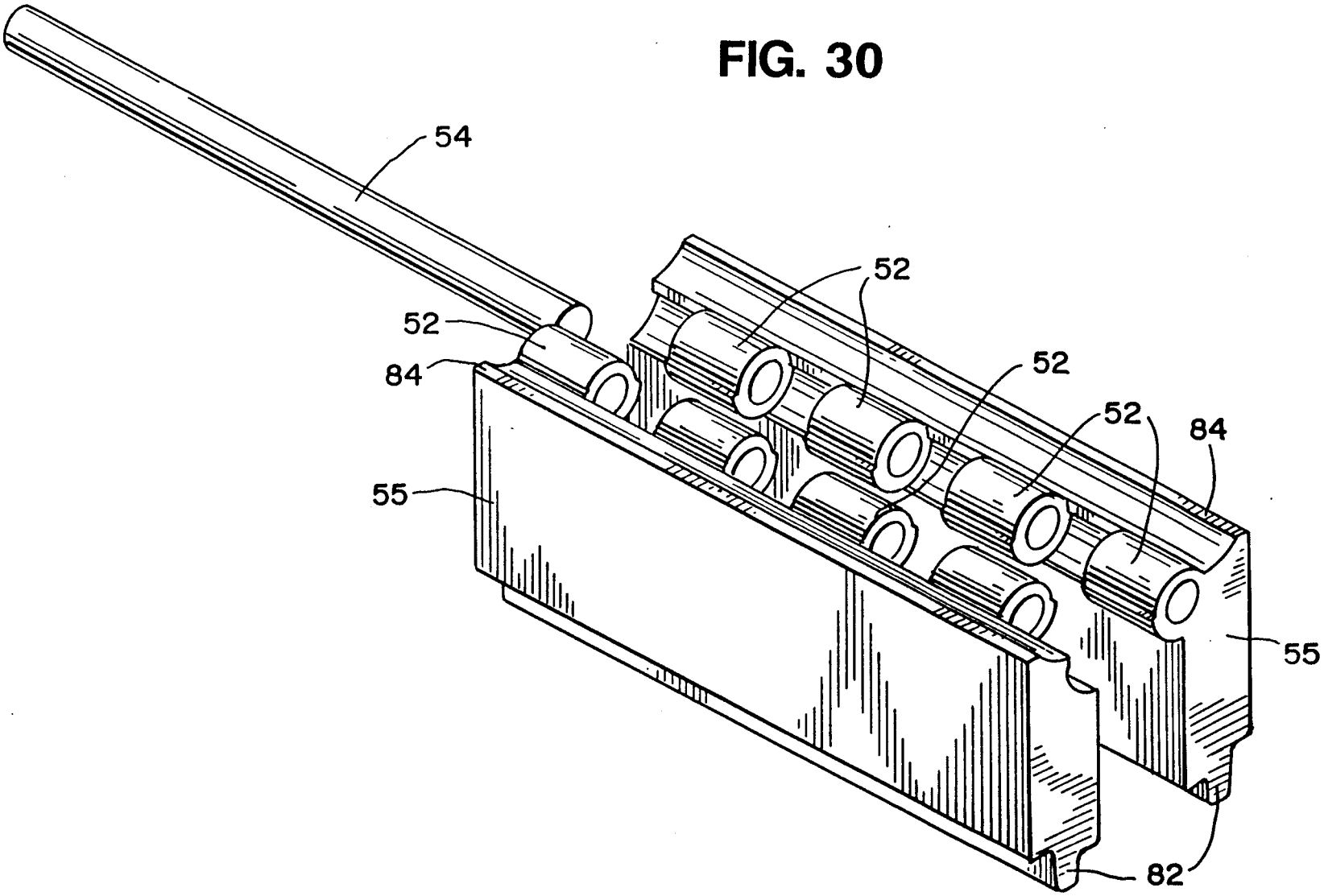

Although the invention has been described in detail above by reference to especially preferred examples of embodiment thereof, further variations and modifications are nevertheless possible within the scope of this invention. Thus, for example, it is conceivable for the hinge joint connection 53 described in relation to FIGS. 27 to 35 to be provided with a continuous hinge pin 54, having a length corresponding to the width of the machine. On the other hand, with the divided hinge arrangements as shown in FIG. 30, it is also possible for each hinge pin 54 to project somewhat at one side beyond the tool segment pairs 55 and to penetrate into the hinge eyes 52 of the next pair of tool segments 55, so that in this manner a connection between the individual pairs of tool components is achieved.

It is furthermore also conceivable, instead of the described vertical alignment of the bending device 1, where the sheet 18 to be bent is fed in horizontally, to adopt a different alignment, in principle an inclined alignment, with appropriate inclined introduction of the sheet 18 in the starting position. For this purpose, only components of the frame would need to be modified accordingly.

For the drive motors, such as the drive motors 72, 73 for pivoting the bending punches 19, 20, and also the drive motor or motors for the two spindle drives 14, suitable electrical control circuits can be provided to enable these drive motors each to be switched on and off as required. In principle, instead of these electrical drive motors, it is of course possible for hydraulic motors or pressure fluid cylinders to be used.

It is furthermore possible to move the upper punch 10, for example, up and down by means of an eccentric drive or a power cylinder, in which case a locking of the upper punch 10 in the lower working position, e.g. according to FIGS. 3 or 7, can be achieved by simply stopping the eccentric drive in this position. Furthermore, it is also of course possible for circular arc-shaped toothed racks, as explained with reference to FIGS. 22, 26 or 27 to 29, to be used also in the form of embodiment according to FIGS. 1 to 11 (and conversely for straight toothed racks to be used in the form of embodiment according to FIGS. 22 or 26). A subdivision into individual tool segments 55, as explained with reference to FIGS. 22 and 27 to 35, can of course also be provided in all other examples of embodiment.

In a practical example of embodiment according to FIG. 27, the machine width had the dimension 1,500 mm, the length of the tool segments 55 was 125 mm, and the thickness of the hinge pin 54 was 8 mm; the pitch for the pivot drives 24 was 400 mm, and the outer drive units were each offset by approx. 150 mm from the end faces of the device 1. The total mass of the bending device 1 was less than 500 kg, and 2 mm thick metal sheets could be bent without difficulty.

I claim:

1. A sheet bending device comprising:

three punches, the first and second of said three punches being bending punches which are disposed adjacent to one another and have sheet contact zones, each of said two bending punches including removable tool segments disposed adjacent to one another in an aligned relationship and defining, with their respective sheet contact portions, said sheet contact zones, the third of said three punches being a counter-punch which is positioned opposite to said two bending punches;

means for linearly moving said counter-punch between a retracted inoperative position away from said two bending punches and an operative position adjacent said two bending punches, in which operative position a sheet may be bent around said counter-punch;

pivoting drive means respectively coupled to the first and second of said three punches for pivoting the first and second bending punches to provide a bending force for bending the sheet around said counter-punch; and hinge means for pivotally connecting said two bending punches for relative movement about a hinge axis from a first position in which their sheet contact zones are aligned one to another and define a sheet bearing plane, to a second position in which their sheet contact zones define an angle therebetween;

wherein respective tool segments of said two bending punches are connected to each other in pairs by hinge connections which together form said hinge means connecting said two bending punches, said hinge axis being offset from said sheet bearing plane, a depression being provided in each of said tool segments between the respective hinge connection and the respective sheet contact portion.

2. A sheet bending device as defined in claim 1, wherein said two bending punches are pivotally movable independently from each other, and wherein said pivoting drive means comprise two sets of pivotal drives respectively coupled to said two bending punches, said pivotal drives being distributed in spaced relationship over the width of the sheet bending device.

3. A sheet bending device as defined in claim 2, wherein the counter-punch is arranged only for a linear movement to and from said two oppositely arranged bending punches.

4. A sheet bending device as defined in claim 3, wherein said counter-punch is capable of being retracted from said two bending punches, in order to make a further folding of the sheet in the last phase of a sheet bending operation.

5. A sheet bending device as defined in claim 1, wherein one of said two bending punches is stationarily mounted and the other bending punch and the counter-punch are pivotally mounted, the pivotal bending punch being drivable at twice the angular velocity of the counter-punch.

6. A sheet bending device as defined in claim 1, wherein said tool segments are held, at locations remote from their sheet contact portions, to the bending punches, which function as tool holders, by means of a push-in connection.

7. A sheet bending device as defined in claim 6, wherein said push-in connection is a tongue-and-groove connection.

8. A sheet bending device as defined in claim 1, wherein the respective tool segment pairs are provided with own hinge pins adapted to the tool segment length.

9. A sheet bending device as defined in claim 8, wherein each of the tool segment hinge pins projects at one side into the hinge connection of the adjoining tool segment pair.

10. A sheet bending device as defined in claim 1, wherein the tool segment pairs are provided with a single hinge axis extending through all said tool segment pairs.

11. A sheet bending device as defined in claim 1, wherein the tool segments are provided with separate inserts constituting the sheet contact portions.

12. A sheet bending device as defined in claim 11, wherein the inserts are screwed to the tool segments.

13. A sheet bending device as defined in claim 1, wherein said pivoting drive means comprise respective circular arc-shaped tooth racks firmly connected to the respectively associated punches and driven by pinions seated on two respective shafts.

14. A sheet bending device as defined in claim 13, wherein each circular arc-shaped tooth rack is journalled in a circular arc-shaped bearing on a stationary bearing component.

15. A sheet bending device as defined in claim 12, wherein two separate electric motors are provided for respectively rotating the two shafts associated with the bending punches.

16. A sheet bending device as defined in claim 1, wherein the counter-punch is pivotally mounted on a support, which is linearly movable, about an axis extending generally in the region of bending of the bent sheet.

* * * * *

UNITED STATES PATENT AND TRADEMARK OFFICE

CERTIFICATE OF CORRECTION

PATENT NO. : 5,295,384

DATED : March 22, 1994

INVENTOR(S) : Otto SCHUBERT

It is certified that error appears in the above—identified patent and that said Letters Patent is hereby corrected as shown below:

On the title page,
item [30], change "[AU] Australia" to —[AT] Austria—;

insert —Mar. 15, 1990 [AT] Austria 621/90—;

insert —Mar. 14, 1991 [WO] PCT AT91/00044—.

Signed and Sealed this

Twenty-seventh Day of September, 1994

*Attest:*

Bruce Lehman

BRUCE LEHMAN

*Attesting Officer*

*Commissioner of Patents and Trademarks*